US009577316B2

(12) United States Patent
Jeong

(10) Patent No.: US 9,577,316 B2
(45) Date of Patent: Feb. 21, 2017

(54) ANTENNA WITH A COMBINED BANDPASS/BANDSTOP FILTER NETWORK

(71) Applicant: BlackBerry Limited, Waterloo (CA)

(72) Inventor: Seong Heon Jeong, Irving, TX (US)

(73) Assignee: BlackBerry Limited, Waterloo, Ontario (CA)

( * ) Notice: Subject to any disclaimer, the term of this patent is extended or adjusted under 35 U.S.C. 154(b) by 98 days.

(21) Appl. No.: 13/931,036

(22) Filed: Jun. 28, 2013

(65) Prior Publication Data

US 2015/0002347 A1 Jan. 1, 2015

(51) Int. Cl.
*H01Q 1/24* (2006.01)
*H01Q 9/30* (2006.01)
*H01Q 5/321* (2015.01)

(52) U.S. Cl.
CPC ..... *H01Q 1/243* (2013.01); *H01Q 5/321* (2015.01); *H01Q 9/30* (2013.01)

(58) Field of Classification Search
CPC ..... H01Q 1/36
USPC ..... 343/722, 746, 702
See application file for complete search history.

(56) References Cited

U.S. PATENT DOCUMENTS 5,815,804 A 9/1998 Newell et al.
7,230,575 B2 * 6/2007 Jeong ..... H01Q 1/243 343/700 MS
7,436,365 B1 10/2008 Tan et al.
8,120,542 B2 2/2012 Shoji
8,125,399 B2 * 2/2012 McKinzie ..... H01Q 9/0407 343/746
2003/0146873 A1 8/2003 Blancho
2006/0097918 A1 5/2006 Oshiyama et al.
2006/0097941 A1 5/2006 Bettner et al.
2007/0285326 A1 12/2007 McKinzie
(Continued)

FOREIGN PATENT DOCUMENTS

DE 102012204184 9/2012
EP 2161785 3/2010
(Continued)

OTHER PUBLICATIONS

Office Action issued in U.S. Appl. No. 13/930,981 on Apr. 20, 2015; 21 pages.

(Continued)

*Primary Examiner* — Dameon E Levi
*Assistant Examiner* — Walter Davis
(74) *Attorney, Agent, or Firm* — Fish & Richardson P.C.

(57) ABSTRACT

An antenna with a combined bandpass/bandstop filter network is provided. The antenna includes: a first radiating arm connectable to an antenna feed, the first radiating arm configured to resonate at a first frequency; a second radiating arm, the second radiating arm and the first radiating arm, when electrically connected, configured to resonate at a second frequency lower than the first frequency; and, a filter network comprising a bandstop filter and a bandpass filter, the filter network filtering an electrical connection between the first radiating arm and the second radiating arm, the filter network configured to: electrically isolate the first radiating arm from the second radiating arm at the first frequency, and electrically connect the first radiating arm and the second radiating arm at the second frequency.

18 Claims, 16 Drawing Sheets

(56) References Cited

U.S. PATENT DOCUMENTS

| | | | | |
|---|---|---|---|---|
| 2010/0053007 | A1* | 3/2010 | Ni | H01Q 9/0421 343/745 |
| 2010/0060530 | A1 | 3/2010 | Shoji | |
| 2010/0149053 | A1* | 6/2010 | Nakano | H01Q 1/243 343/702 |
| 2011/0175789 | A1* | 7/2011 | Lee | H01Q 1/243 343/853 |
| 2011/0254749 | A1 | 10/2011 | Amari et al. | |
| 2012/0044116 | A1 | 2/2012 | Chiang | |
| 2012/0242552 | A1 | 9/2012 | Nishi et al. | |

FOREIGN PATENT DOCUMENTS

| | | |
|---|---|---|
| EP | 2182583 | 5/2010 |
| JP | 2004032303 | 1/2004 |
| JP | 2004129234 | 4/2004 |
| JP | 2004304705 | 10/2004 |
| WO | 0211236 | 2/2002 |
| WO | 2010025095 | 3/2010 |

OTHER PUBLICATIONS

Office Action issued in U.S. Appl. No. 13/930,981 on Oct. 19, 2015; 23 pages.

European Patent Office, Extended European Search Report issued in connection with European Application No. 13174421.1, dated Dec. 12, 2013, 7 pages.

European Patent Office, Extended European Search Report issued in connection with European Application No. 13174418.7, dated Dec. 12, 2013, 7 pages.

* cited by examiner

ANTENNA WITH A COMBINED BANDPASS/BANDSTOP FILTER NETWORK

FIELD

The specification relates generally to antennas, and specifically to an antenna with a combined bandpass/bandstop filter network.

BACKGROUND

Current mobile electronic devices, such as smartphones, tablets and the like, generally have different antennas implemented to support different types of wireless protocols and/or to cover different frequency ranges. For example, LTE (Long Term Evolution) bands, GSM (Global System for Mobile Communications) bands, UMTS (Universal Mobile Telecommunications System) bands, and/or WLAN (wireless local area network) bands, cover frequency ranges from 700 to 960 MHz, 1710-2170 MHz, and 2500-2700 MHz and the specific channels within these bands can vary from region to region necessitating the use of different antennas for each region in similar models of devices. This can complicate both resourcing and managing the different antennas for devices in each region.

BRIEF DESCRIPTIONS OF THE DRAWINGS

For a better understanding of the various implementations described herein and to show more clearly how they may be carried into effect, reference will now be made, by way of example only, to the accompanying drawings in which.

Figure 2:
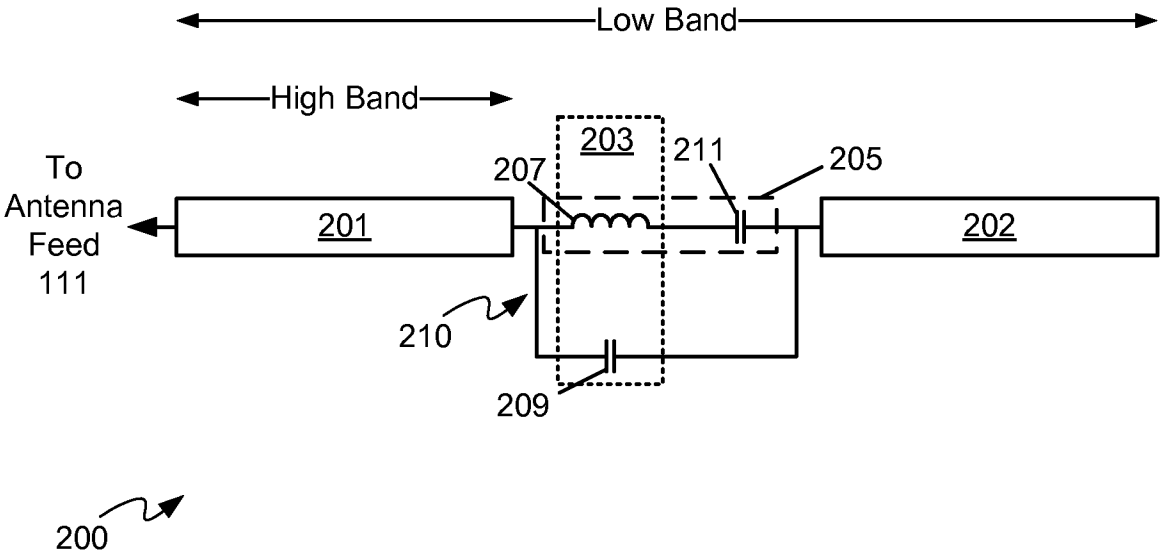
FIG. 2 depicts a schematic diagram of an antenna with a combined bandpass/bandstop filter network that can be used in the device of FIG. 1, according to non-limiting implementations.
Figure 5:
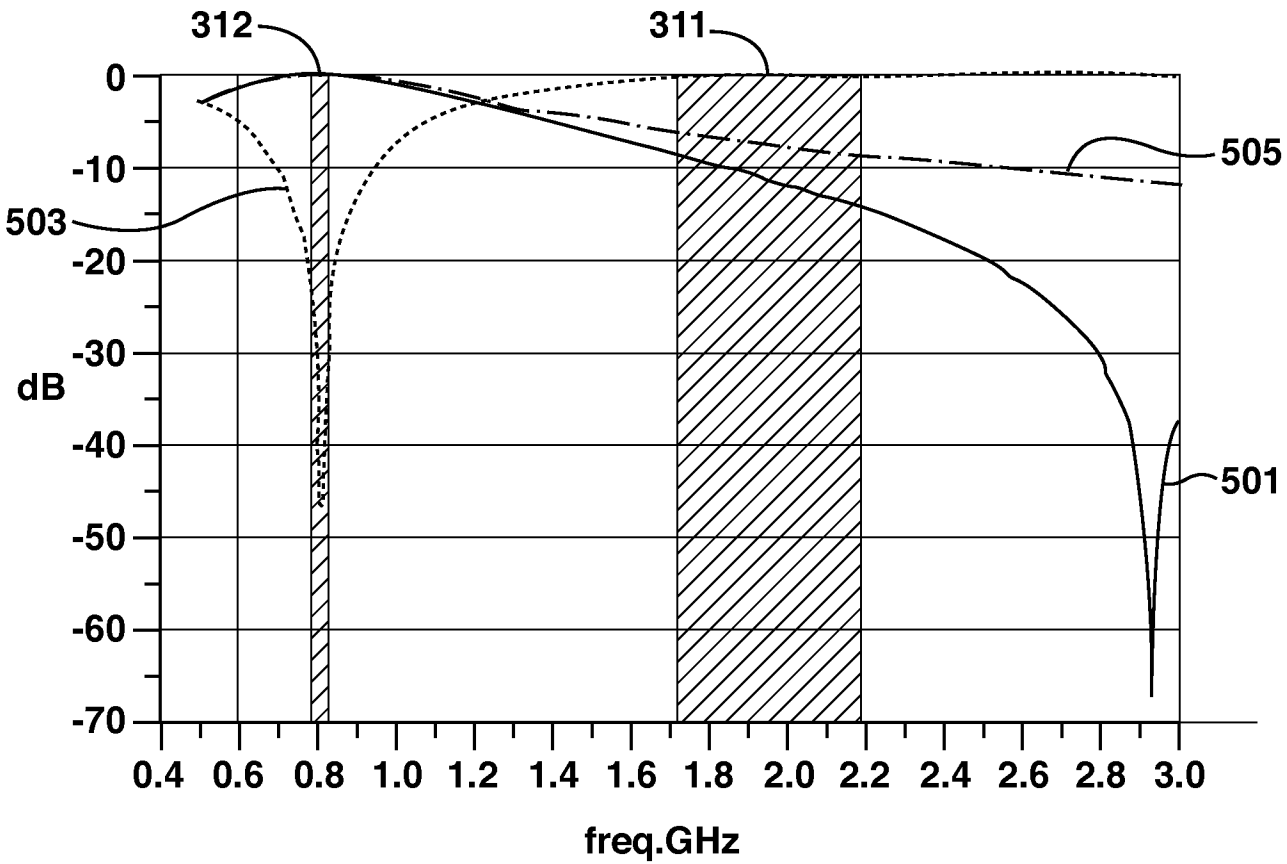

FIG. 5 depicts transmission coefficients (i.e. S21) and reflection coefficients (i.e. S11) of the bandpass/bandstop filter network of FIG. 2, as well as transmission coefficients of only the bandpass filter for comparison, according to non-limiting implementations.

Figure 6:
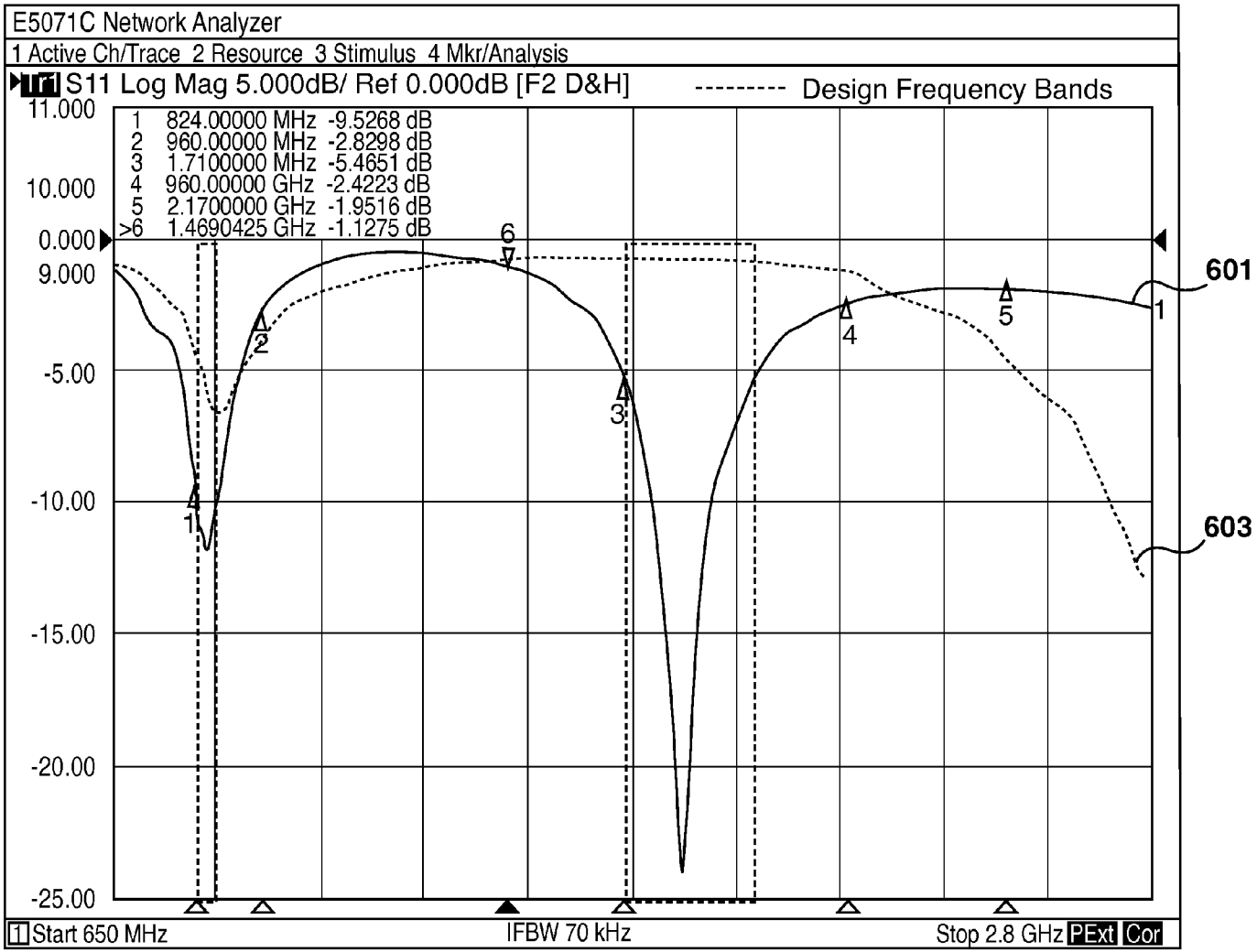

FIG. 6 depicts a return-loss curve of a successful prototype of the antenna of FIG. 2, and a return-loss curve of a prototype of an equivalent monopole antenna without the bandpass/bandstop filter network, according to non-limiting implementations.

Figure 1:
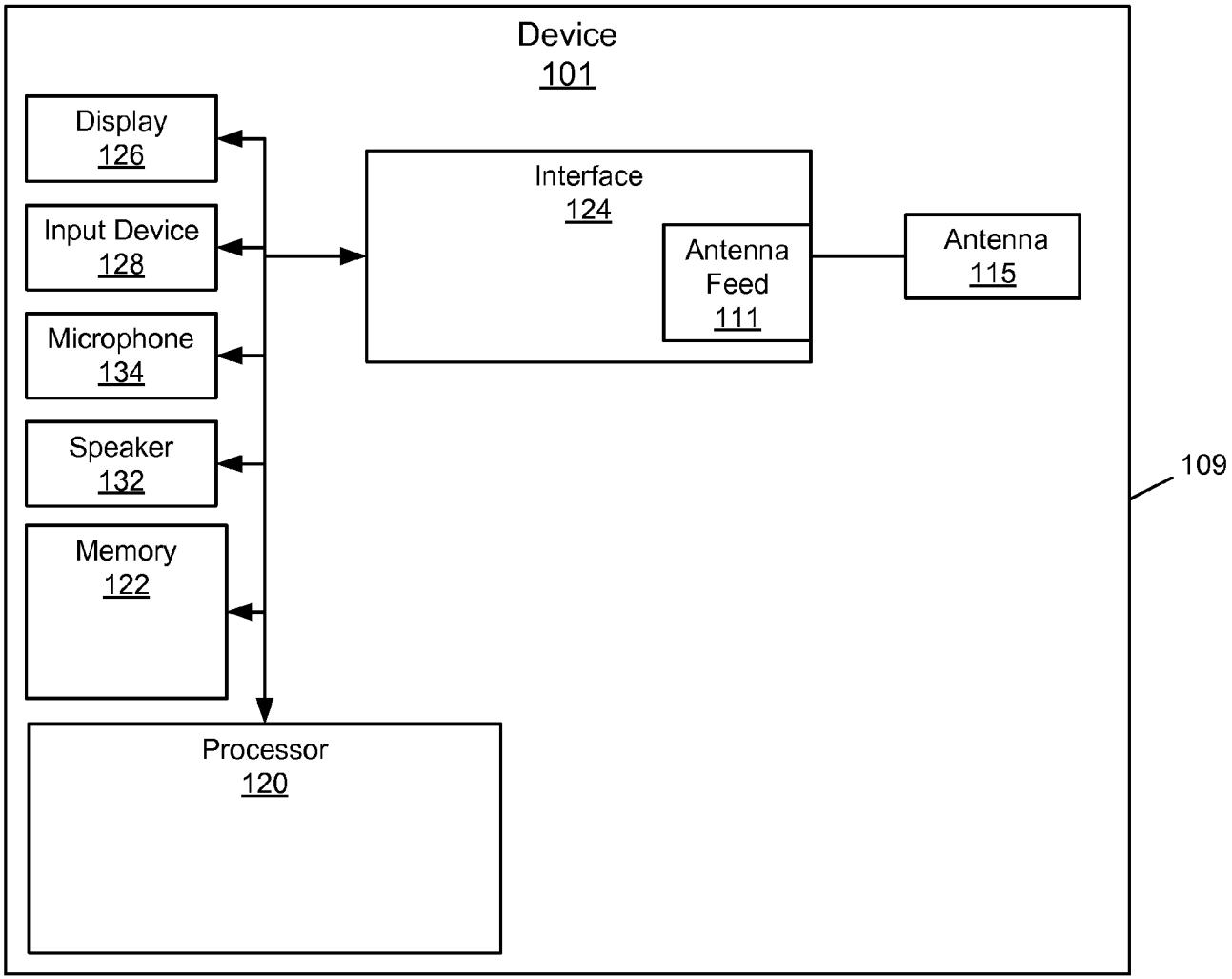
FIG. 1 depicts a schematic diagram of a device including an antenna with a combined bandpass/bandstop filter network, according to non-limiting implementations.
Figure 7:
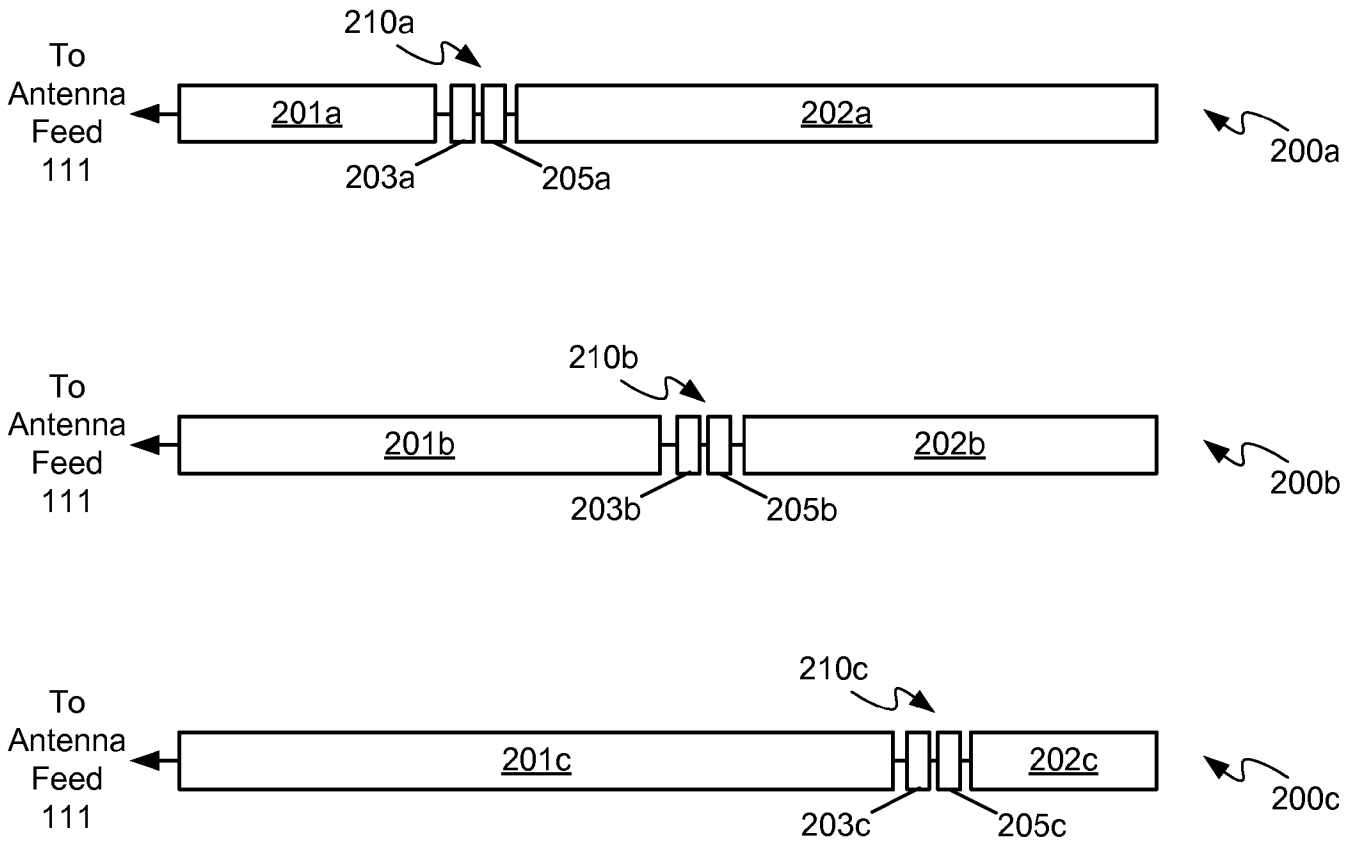

FIG. 7 depicts three antennas that can be used in the device of FIG. 1, each of the antennas similar to the antenna of FIG. 2, but with a bandstop/bandpass filter network at different locations, according to non-limiting implementations.

Figure 8:
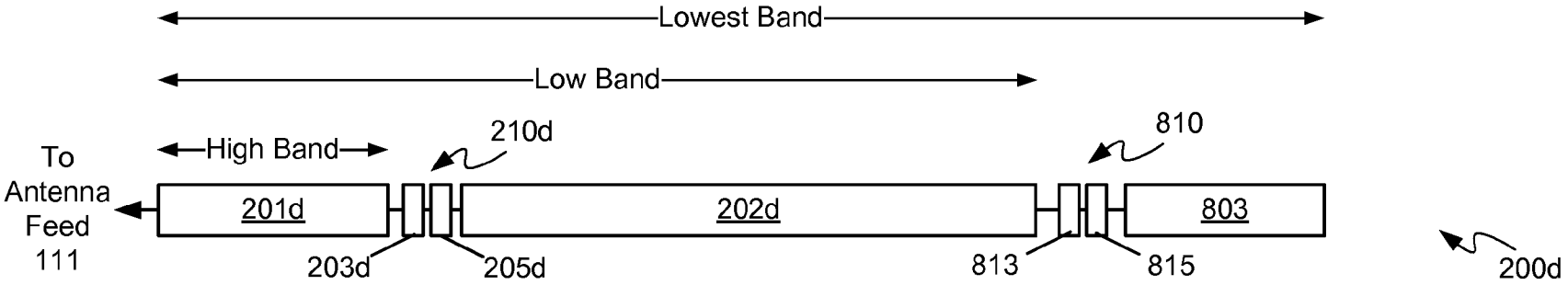

FIG. 8 depicts a schematic diagram of an antenna, with two combined bandpass/bandstop filter networks that can be used in the device of FIG. 1, according to non-limiting implementations.

Figure 9:
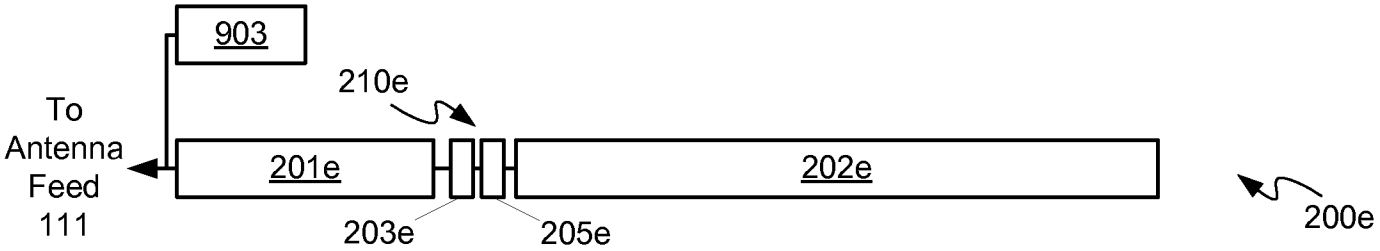

FIG. 9 depicts a schematic diagram of an antenna, with a combined bandpass/bandstop filter network, and an additional radiating arm, that can be used in the device of FIG. 1, according to non-limiting implementations.

Figure 10:
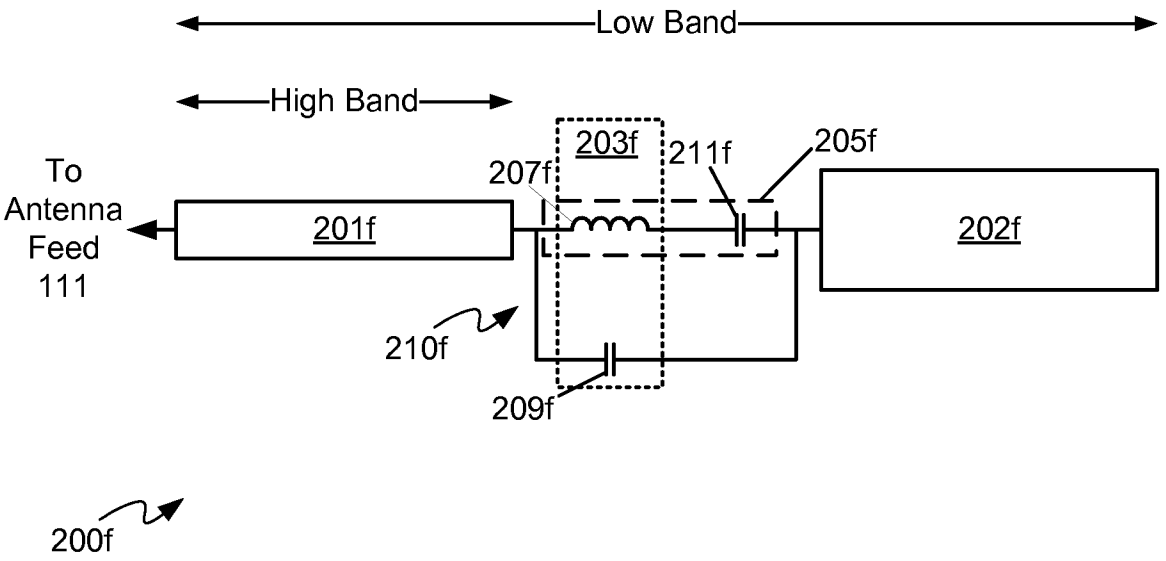

FIG. 10 depicts a schematic diagram of an alternative antenna, with a combined bandpass/bandstop filter network, where radiating arms have different widths, which can be used in the device of FIG. 1, according to non-limiting implementations.

Figure 11:
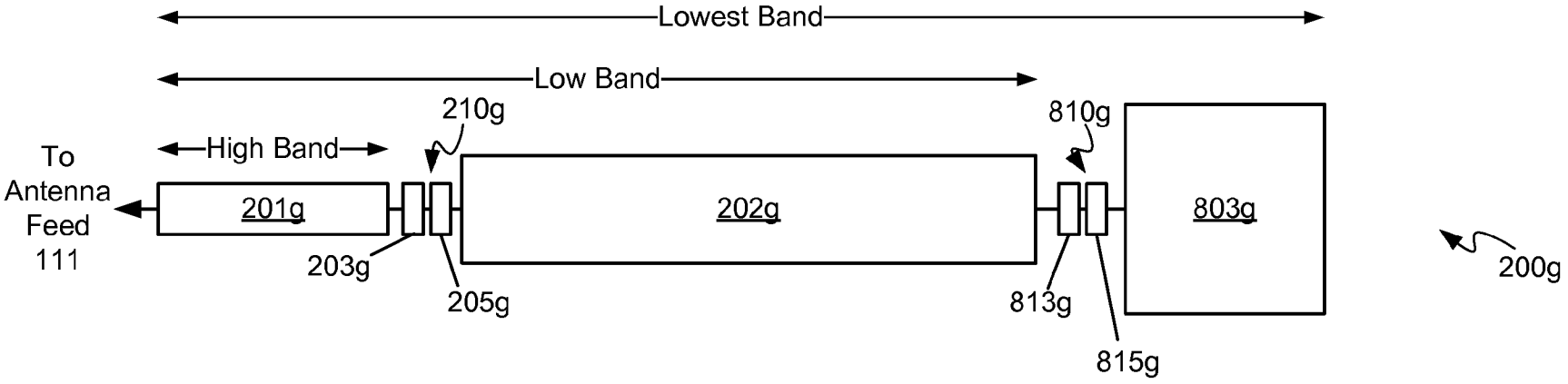

FIG. 11 depicts a schematic diagram of an alternative antenna, with a combined bandpass/bandstop filter network, where radiating arms have different widths, which can be used in the device of FIG. 1, according to non-limiting implementations.

Figure 12:
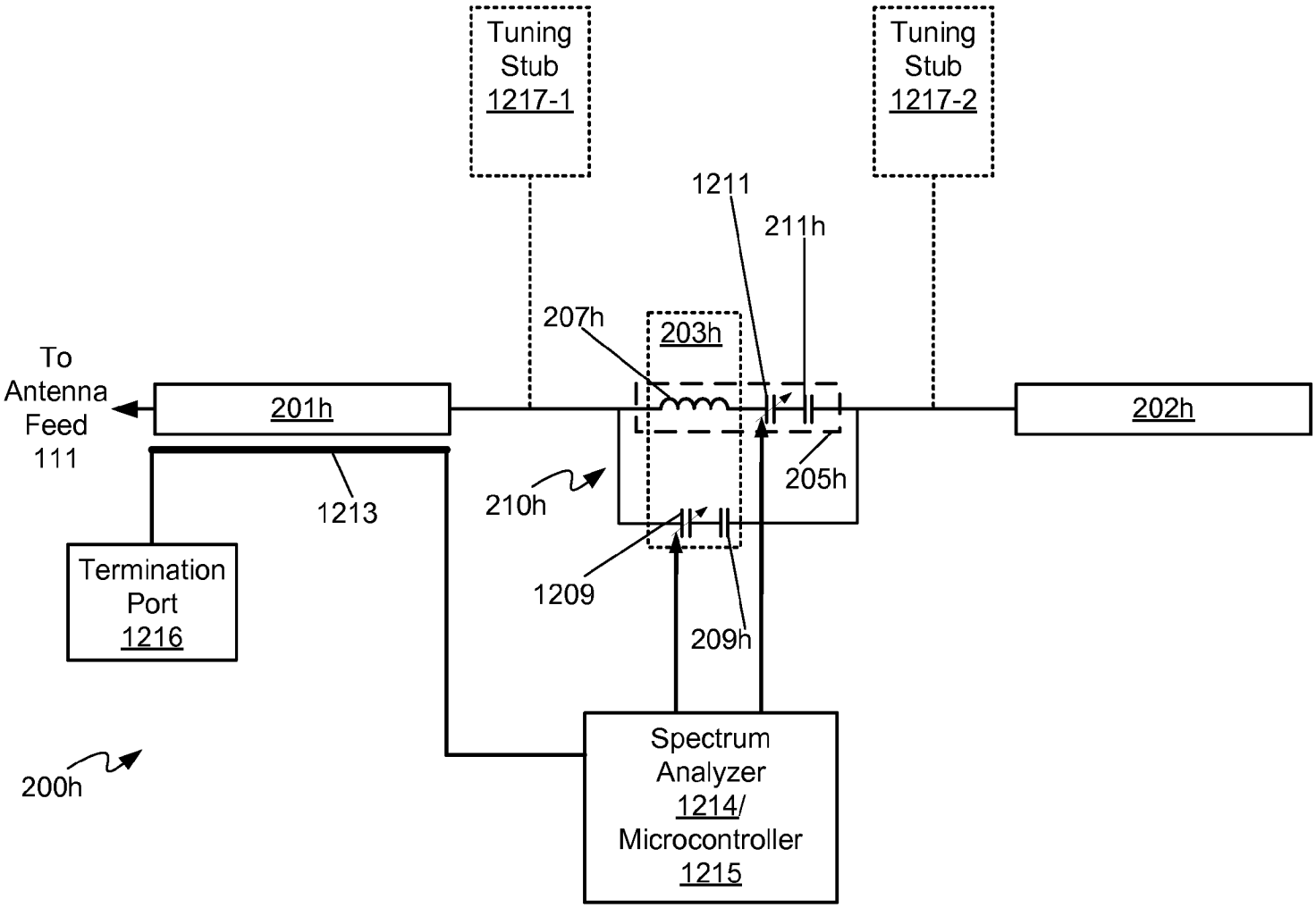

FIG. 12 depicts a schematic diagram of an alternative antenna, with a combined bandpass/bandstop filter network, each of the bandstop filter and the bandpass filter comprising a respective tunable capacitor, which can be used in the device of FIG. 1, according to non-limiting implementations.

Figure 13:
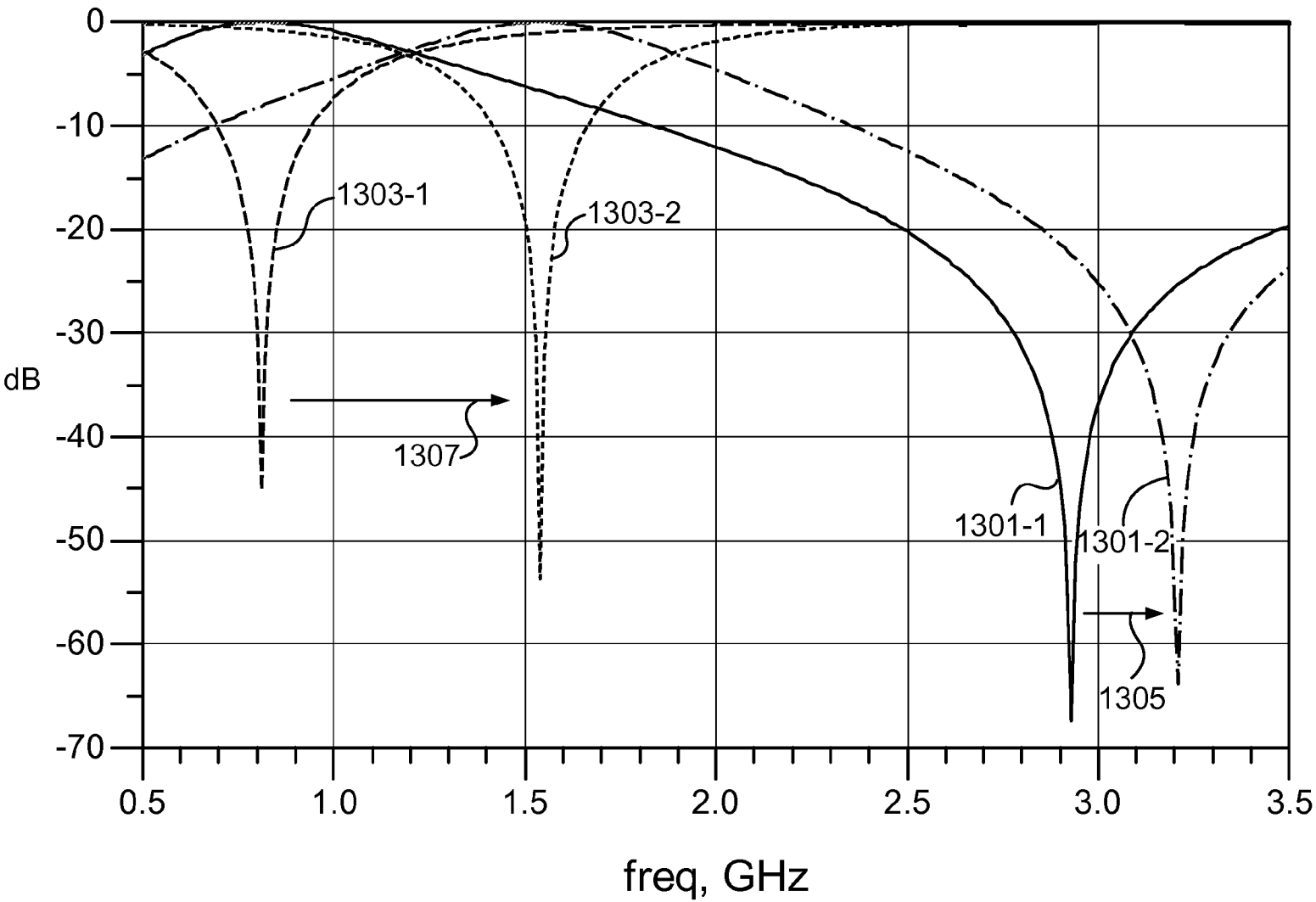

FIG. 13 depicts effect of tuning a tunable bandpass filter capacitor on transmission coefficients (i.e. S21) and reflection coefficients (i.e. S11) of the bandpass/bandstop filter network of FIG. 12, according to non-limiting implementations.

Figure 14:
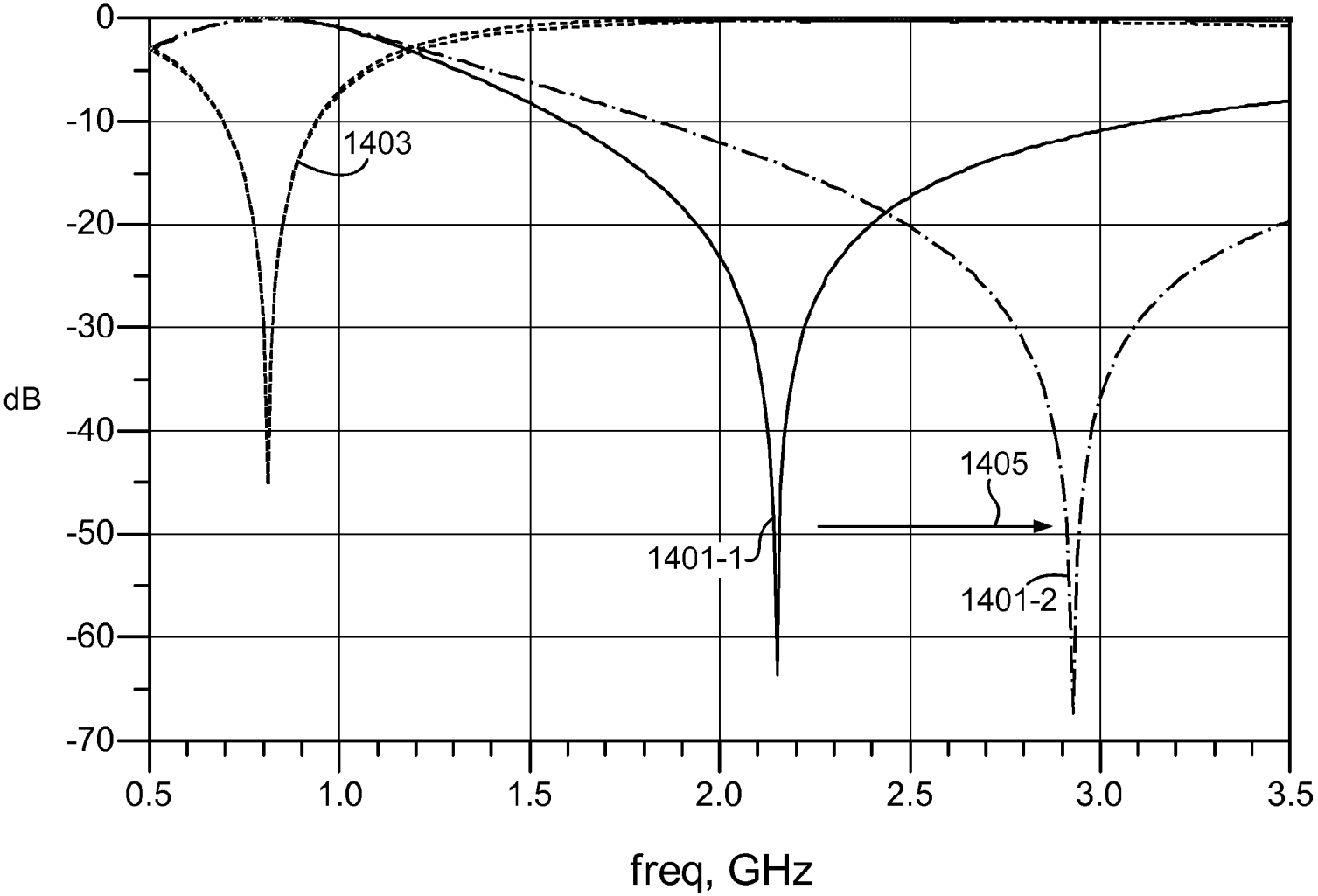

FIG. 14 depicts effect of tuning a tunable bandstop filter capacitor on transmission coefficients (i.e. S21) and reflection coefficients (i.e. S11) of the bandpass/bandstop filter network of FIG. 12, according to non-limiting implementations.

Figure 15:
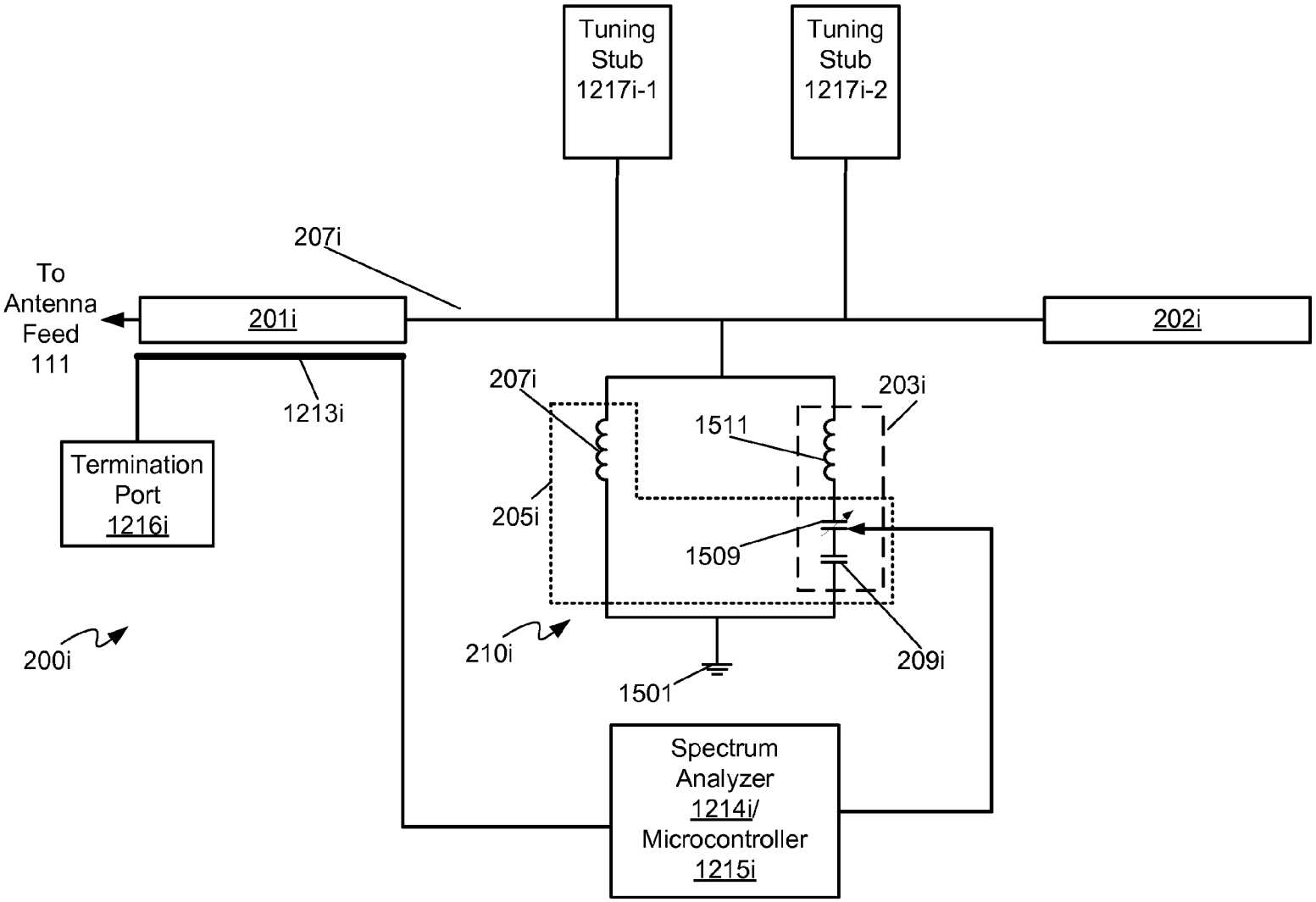

FIG. 15 depicts a schematic diagram of an alternative antenna with a combined bandpass/bandstop filter network with a tunable capacitor, which can be used in the device of FIG. 1, according to non-limiting implementations.

Figure 16:
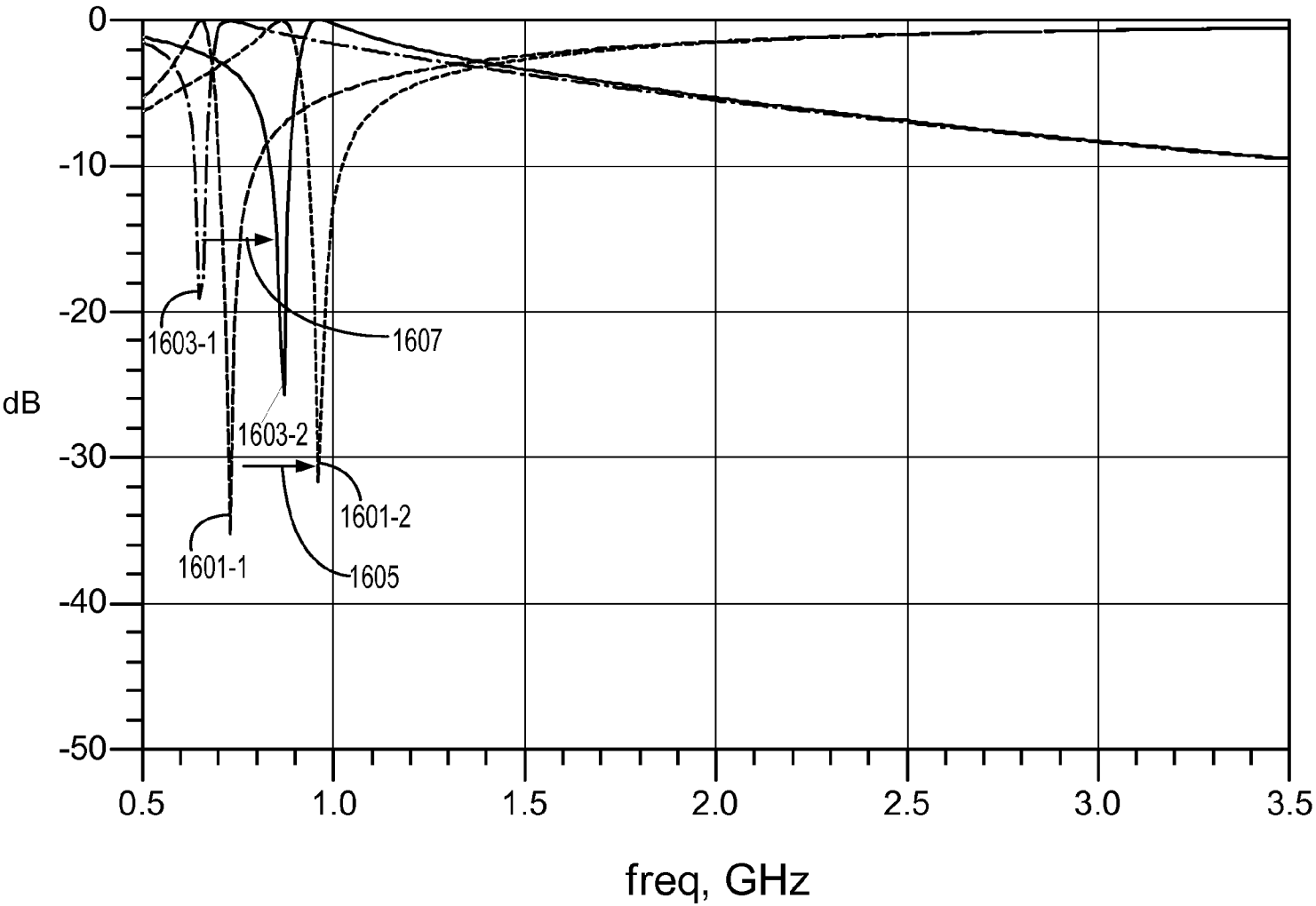

FIG. 16 depicts effect of tuning the capacitor of the bandpass/bandstop filter network of FIG. 15 on transmission coefficients (i.e. S21) and reflection coefficients (i.e. S11), according to non-limiting implementations.

DETAILED DESCRIPTION

The present disclosure describes examples of an antenna with combined bandpass/bandstop filter networks that can resonate at two or more frequency responses to cover bands that include channels for LTE bands, GSM bands, UMTS bands, CDMA bands, GPS bands, and/or WLAN bands in a plurality of geographical regions.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

Furthermore, as will become apparent, in this specification certain elements may be described as connected physically, electrically, or any combination thereof, according to context. In general, components that are electrically connected are configured to communicate (that is, they are capable of communicating) by way of electric signals. According to context, two components that are physically coupled and/or physically connected may behave as a single element. In some cases, physically connected elements may be integrally formed, e.g., part of a single-piece article that may share structures and materials. In other cases, physically connected elements may comprise discrete components that may be fastened together in any fashion. Physical connections may also include a combination of discrete components fastened together, and components fashioned as a single piece.

An aspect of the specification provides an antenna comprising: a first radiating arm connectable to an antenna feed, the first radiating arm configured to resonate at a first frequency; a second radiating arm, the second radiating arm and the first radiating arm, when electrically connected, configured to resonate at a second frequency lower than the first frequency; and, a filter network comprising a bandstop filter and a bandpass filter, the filter network filtering an electrical connection between the first radiating arm and the second radiating arm, the filter network configured to: electrically isolate the first radiating arm from the second radiating arm at the first frequency, and electrically connect the first radiating arm and the second radiating arm at the second frequency.

The filter network can join the first radiating arm to the second radiating arm.

The first radiating arm can have a length corresponding to resonance at the first frequency.

The first radiating arm and the second radiating arm can form a line and a total length of the first radiating arm and the second radiating arm can correspond to resonance at the second frequency.

The first radiating arm and the second radiating can behave as a single radiating arm at the second frequency.

The filter network isolates the first radiating arm from the second radiating arm at the first frequency such that the second radiating arm does not contribute resonance at the first frequency.

The bandstop filter can comprise an inductor and a first capacitor connected in parallel between the first radiating arm and the second radiating arm. The bandpass filter can comprise the inductor and a second capacitor connected in series with the inductor. The first radiating arm, the inductor, the second capacitor and the second radiating arm can be connected in series, the inductor electrically adjacent the first radiating arm and the second capacitor electrically adjacent the second radiating arm. The inductor can have an inductance of about 22 nH, the first capacitor has a capacitance of about 0.15 pF, and the second capacitor has a capacitance of about 1.8 pF.

The first radiating arm can be configured to resonate between about 1800 MHz to about 2100 MHz.

The combination of the first radiating arm electrically connected to the second radiating arm can be configured to resonate between about 700 MHz to about 900 MHz.

The antenna can further comprise: a third radiating arm, the third radiating arm, the second radiating arm and the first radiating arm, when electrically connected, configured to resonate at a third frequency lower than the second frequency; and, a second filter network comprising a second bandstop filter and a second bandpass filter, the second filter network filtering a respective electrical connection between the second radiating arm and the third radiating arm, the second filter network configured to: electrically isolate the second radiating arm from the third radiating arm at the second frequency, and electrically connect the second radiating arm and the third radiating arm at the third frequency. The filter network is further configured to electrically connect the first radiating arm to the second radiating arm at the third frequency.

The antenna can further comprise at least a third radiating arm connectable to the antenna feed, the third radiating arm configured to resonate at a third frequency different from the first frequency and the second frequency.

One or more of the bandstop filter and the bandpass filter can be tunable.

One or more of the bandstop filter and the bandpass filter can comprise at least one tunable capacitor. The antenna can further comprise: a directional coupler capacitively coupled to the first radiating arm; and, a spectrum analyzer and microcontroller in communication with the directional coupler and the at least one tunable capacitor, the spectrum analyzer configured to determine an input frequency of the first radiating arm and the microcontroller configured to tune the at least one tunable capacitor according to the input frequency.

The filter network can be connected in shunt from each of the first radiating arm and the second radiating arm to a ground.

The first radiating arm and the second radiating arm can be different widths.

FIG. 1 depicts a schematic diagram of a mobile electronic device 101, referred to interchangeably hereafter as device 101, according to non-limiting implementations. Device 101 comprises: a chassis 109 comprising a ground plane; an antenna feed 111, and an antenna 115 with a combined bandpass/bandstop filter network connected to the antenna feed 111, described in further detail below. Device 101 can be any type of electronic device that can be used in a self-contained manner to communicate with one or more communication networks using antenna 115. Device 101 includes, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations. Device hence further comprise a processor 120, a memory 122, a display 126, a communication interface 124 that can optionally comprise antenna feed 111, at least one input device 128, a speaker 132 and a microphone 134. Processor 120 is also in communication with one or more switches of antenna 115, as described in further detail below.

It should be emphasized that the structure of device 101 in FIG. 1 is purely an example, and contemplates a device that can be used for both wireless voice (e.g. telephony) and wireless data communications (e.g. email, web browsing, text, and the like). However, FIG. 1 contemplates a device that can be used for any suitable specialized functions, including, but not limited, to one or more of, telephony, computing, appliance, and/or entertainment related functions.

Device 101 comprises at least one input device 128 generally configured to receive input data, and can comprise any suitable combination of input devices, including but not limited to a keyboard, a keypad, a pointing device, a mouse, a track wheel, a trackball, a touchpad, a touch screen and the like. Other suitable input devices are within the scope of present implementations.

Input from input device 128 is received at processor 120 (which can be implemented as a plurality of processors, including but not limited to one or more central processors (CPUs)). Processor 120 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 which makes appropriate utilization of volatile storage during the execution of such programming instructions. Those skilled in the art will now recognize that memory 122 is an example of computer readable media that can store programming instructions executable on processor 120. Furthermore, memory 122 is also an example of a memory unit and/or memory module.

Processor 120 can be further configured to communicate with display 126, and microphone 134 and speaker 132. Display 126 comprises any suitable one of, or combination of, CRT (cathode ray tube) and/or flat panel displays (e.g. LCD (liquid crystal display), plasma, OLED (organic light emitting diode), capacitive or resistive touchscreens, and the like). Microphone 134 comprises any suitable microphone for receiving sound and converting to audio data. Speaker 132 comprises any suitable speaker for converting audio data to sound to provide one or more of audible alerts, audible communications from remote communication devices, and the like. In some implementations, input device 128 and display 126 are external to device 101, with processor 120 in communication with each of input device 128 and display 126 via a suitable connection and/or link.

Processor 120 also connects to communication interface 124 (interchangeably referred to interchangeably as interface 124), which can be implemented as one or more radios and/or connectors and/or network adaptors, configured to wirelessly communicate with one or more communication networks (not depicted) via antenna 115. It will be appreciated that interface 124 is configured to correspond with network architecture that is used to implement one or more communication links to the one or more communication networks, including but not limited to any suitable combination of USB (universal serial bus) cables, serial cables, wireless links, cell-phone links, cellular network links (including but not limited to 2G, 2.5G, 3G, 4G+ such as UMTS (Universal Mobile Telecommunications System), GSM (Global System for Mobile Communications), CDMA (Code division multiple access), FDD (frequency division duplexing), LTE (Long Term Evolution), TDD (time division duplexing), TDD-LTE (TDD-Long Term Evolution), TD-SCDMA (Time Division Synchronous Code Division Multiple Access) and the like, wireless data, Bluetooth links, NFC (near field communication) links, WLAN (wireless local area network) links, WiFi links, WiMax links, packet based links, the Internet, analog networks, the PSTN (public switched telephone network), access points, and the like, and/or a combination.

Specifically, interface 124 comprises radio equipment (i.e. a radio transmitter and/or radio receiver) for receiving and transmitting signals using antenna 115. It is further appreciated that, as depicted, interface 124 comprises antenna feed 111, which alternatively can be separate from interface 124.

Device 101 further comprises a power source, not depicted, for example a battery or the like. In some implementations the power source can comprise a connection to a mains power supply and a power adaptor (e.g. and AC-to-DC (alternating current to direct current) adaptor).

Device 101 further comprises an outer housing which houses components of device 101, including chassis 109. Chassis 109 can be internal to the outer housing and be configured to provide structural integrity to device 101. Chassis 109 can be further configured to support components of device 101 attached thereto, for example, display 126. In specific implementations chassis 109 can comprise one or more of a conducting material and a conducting metal, such that chassis 109 forms a ground and/or a ground plane of device 101; in alternative implementations, at least a portion of chassis 109 can comprise one or more of a conductive covering and a conductive coating which forms the ground plane.

In any event, it should be understood that a wide variety of configurations for device 101 are contemplated.

Antenna 115 can comprise a wide variety of configurations as described hereafter. For example, attention is next directed to FIG. 2, which depicts non-limiting implementations of an antenna 200. Antenna 115 can comprise antenna 200.

Antenna 200 comprises: a first radiating arm 201 connectable to antenna feed 111, first radiating arm 201 configured to resonate at a first frequency; a second radiating arm 202, second radiating arm 202 and first radiating arm 201, when electrically connected, configured to resonate at a second frequency lower than the first frequency; a filter network 210 comprising a bandstop filter 203 and a bandpass filter 205, filter network 210 filtering an electrical connection between first radiating arm 201 and second radiating arm 202, filter network 210 configured to: electrically isolate first radiating arm 201 from second radiating arm 202 at the first frequency, and electrically connect first radiating arm 201 and second radiating arm 202 at the second frequency. In some implementations, as depicted in FIG. 1, filter network 210 joins first radiating arm 201 to second radiating arm 202. Filter network 210 is generally configured to electrically isolate first radiating arm 201 and second radiating arm 202 at a same frequency corresponding to a resonance length defined by a length (labelled "High Band" in FIG. 2) of first radiating arm 201 and to electrically connect first radiating arm 201 and second radiating arm 202 at a frequency corresponding to a resonance length defined by a total length (labelled "Low Band" in FIG. 2) of first radiating arm 201 and second radiating arm 202.

First radiating arm 201 is generally connectable to antenna feed 111 using any suitable connector, including, but not limited to, wires, solder, plugs, electronic traces, and the like. Indeed, in some implementations first radiating arm 201 is hardwired to antenna feed 111. Indeed, antenna 200 can comprise a connector to antenna feed 111.

It is further appreciated that each of first radiating arm 201 and second radiating arm 202 comprise monopole antennas. For example, first radiating arm 201 has a length corresponding to resonance at the first frequency (the length labelled as "High Band" in FIG. 2); and first radiating arm 201 and the second radiating arm form a line and a total length of first radiating arm 201 and second radiating arm 202 corresponds to resonance at the second frequency (the total length labelled as "Low Band" in FIG. 2, and includes the area between first radiating arm 201 and second radiating arm 202, including bandstop filter 203 and bandpass filter 205). In other words, first radiating arm 201 and second radiating arm 202 behave as a single radiating arm, and/or a single monopole antenna of the "Low Band" length, at the second frequency. Filter network 210 isolates first radiating arm 201 from second radiating arm at the first frequency such that second radiating arm 202 does not contribute resonance at the first frequency, and first radiating arm 201 acts as a single monopole antenna at the first frequency, of the "High Band" length.

In other words, antenna 200 comprises at least two resonances, a first resonance at the first frequency that corresponds to first radiating arm 201, and a second resonance at a second frequency lower than the first frequency that corresponds to a resonance of a monopole antenna that is a size and/or length and/or shape of first radiating arm 201 combined with second radiating arm 202. Filter network 210 electrically isolates second radiating arm 202 from first radiating arm 201 at the higher first frequency, and electrically connects the first radiating arm 201 to second radiating arm 202 at the lower second frequency. As antenna 200 is being fed from antenna feed 111 via first radiating arm 201, second radiating arm 202 does not resonate in isolation from first radiating arm 201.

Further, in FIG. 2, a length of first radiating arm 201 is designated as "High Band" and a length of the combination of first radiating arm 201 and second radiating arm 202 is designated as "Low Band", with the "Low Band" length being longer than the "High Band" length; hence, first radiating arm 201 will resonate at a higher frequency than the combination of first radiating arm 201 electrically connected to second radiating arm 202.

In general, a respective length and/or size and/or shape of each of first radiating arm 201 and second radiating arm 202 is chosen such that first radiating arm 201 and second radiating arm 202 to correspond with desired resonance frequencies. In specific non-limiting implementations, a length and/or size and/or shape of first radiating arm 201 is chosen so that first radiating arm 201 resonates between about 1800 MHz to about 1900 MHz. Put another way, first radiating arm 201 can be configured to resonate between about 1800 MHz to about 1900 MHz.

Similarly, a length and/or size and/or shape of second radiating arm 202 is chosen so that the combination of first radiating arm 201 and second radiating arm 202 resonates between about 850 MHz to about 900 MHz. Put another way, the combination of first radiating arm 201 electrically connected to second radiating arm 202 is configured to resonate between about 850 MHz to about 900 MHz.

The bands of about 1800 MHz to about 1900 MHz (e.g. the first frequency) and about 850 MHz to about 900 MHz (e.g. the second frequency) can be chosen as they correspond to bands in commercial networks, including, but not limited to GSM networks and 4G LTE networks, however other bands are within a scope of present implementations. For example, two frequency bands from 700 to 960 MHz, 1710-2170 MHz, and 2500-2700 MHz can be chosen to correspond with commercially used frequency bands.

Furthermore, while each of first radiating arm 201 and second radiating arm 202 are depicted as linear monopole antennas aligned along a longitudinal axis of antenna 200, in other implementations first radiating arm 201 and second radiating arm 202 can be arranged at angles to one another to shape a radiation pattern of antenna 200. Furthermore, one or more of first radiating arm 201 and second radiating arm 202 can comprise a shape more complex than the depicted linear monopole antenna, to shape a radiation pattern of antenna 200. In these implementations, it is appreciated that one or more of the "High Band" length and the "Low Band" length can comprise one or more of an electrical length and a resonant length rather than a physical length. Indeed, due to fringe effects that can occur with linear monopole antennas, the "High Band" length and the "Low Band" length can comprise one or more of an electrical length and a resonant length rather than a physical length even for first radiating arm 201 and second radiating arm 202 as depicted.

It is further appreciated that as frequency is being increased bandstop filter 203, the low frequency band is passed first and a high frequency band is stopped later. Hence bandstop filter 203 blocks the second frequency from reaching bandpass filter 205, thereby increasing the sharpness of the response of bandpass filter 205 and removing out-of-band resonances as described in further detail below.

Bandstop filter 203 and bandpass filter 205 can be combined in filter network 210, and furthermore can share components. For example, in specific non-limiting implementations, as depicted, bandstop filter 203 comprises an inductor 207 and a first capacitor 209 connected in parallel (and/or in shunt) between first radiating arm 201 and second radiating arm 202. It is further appreciated that components of bandstop filter 203 are indicated by a stippled box. Further, in the depicted specific non-limiting implementations, bandpass filter 205 comprises inductor 207 and a second capacitor 211 connected in series with inductor 207, second capacitor 211 located between inductor 207 and second radiating arm 202. Second capacitor 211 is also connected in parallel with first capacitor 209. It is further appreciated that components of bandpass filter 205 are also indicated by a stippled box different from the stippled box indicating bandstop filter 203.

In other words, first radiating arm 201, inductor 207, second capacitor 211 and second radiating arm 202 are connected in series, and in the recited order, inductor 207 electrically adjacent first radiating arm 201 and second capacitor 211 electrically adjacent second radiating arm 202.

In specific non-limiting implementations, inductor 207 has an inductance of about 22 nH, first capacitor 209 has a capacitance of about 0.15 pF, and second capacitor 211 has a capacitance of about 1.8 pF. These values enable this simply circuit to act as a short circuit between first radiating arm 201 and second radiating arm 202 in frequencies ranging from about 850 MHz to about 900 MHz, and as an open circuit from first radiating arm 201 to second radiating arm 202 in frequencies ranging from about 1800 MHz to about 1900 MHz.

However, values for each of inductor 207, first capacitor 209 and second capacitor 211 can be chosen such that bandstop frequencies and bandpass frequencies correspond with resonance frequencies of first radiating arm 201 and second radiating arm 202. In other words, length, and the like, of each of first radiating arm 201 and second radiating arm 202 and values for each of inductor 207, first capacitor 209 and second capacitor 211 are commensurate with each other.

Furthermore, while specific non-limiting implementations of circuits for bandstop filter 203 and bandpass filter 205 are depicted, in other implementations, other circuits for bandstop filter 203 and bandpass filter 205 can be used. For example, in some implementations, there is no overlap of components of bandstop filter 203 and bandpass filter 205. Further, additional components can be used to increase or decrease the sharpness of filtering of one or more of bandstop filter 203 and bandpass filter 205.

It is further appreciated that an input frequency from antenna feed 111 to antenna 200 can be controlled either by one or more of processor 120 and interface 124. In other words, as device 101 switches communication modes from one frequency band to another frequency band, one or more of processor 120 and interface 124 can cause an input frequency from antenna feed 111 to antenna 200 to switch between the first frequency and the second frequency.

Attention is next directed to FIG. 3 which depicts a return-loss curve of specific non-limiting implementations of antenna 200; in these implementations, first radiating arm 201 is configured resonate between about 1800 MHz to about 1900 MHz, and the combination of first radiating arm 201 electrically connected to second radiating arm 202 is configured to resonate between about 850 MHz to about 900 MHz; further, components of filter network 210 are configured as follows: inductor 201 has an inductance of about 22 nH, first capacitor 209 has a capacitance of about 0.15 pF, and second capacitor 202 has a capacitance of about 1.8 pF. The response of antenna 200 is shown between about 0 MHz and about 3000 MHz (or 3 GHz), with return-loss, in decibels (dB), shown on the y-axis, and frequency shown on the x-axis.

Figure 3:
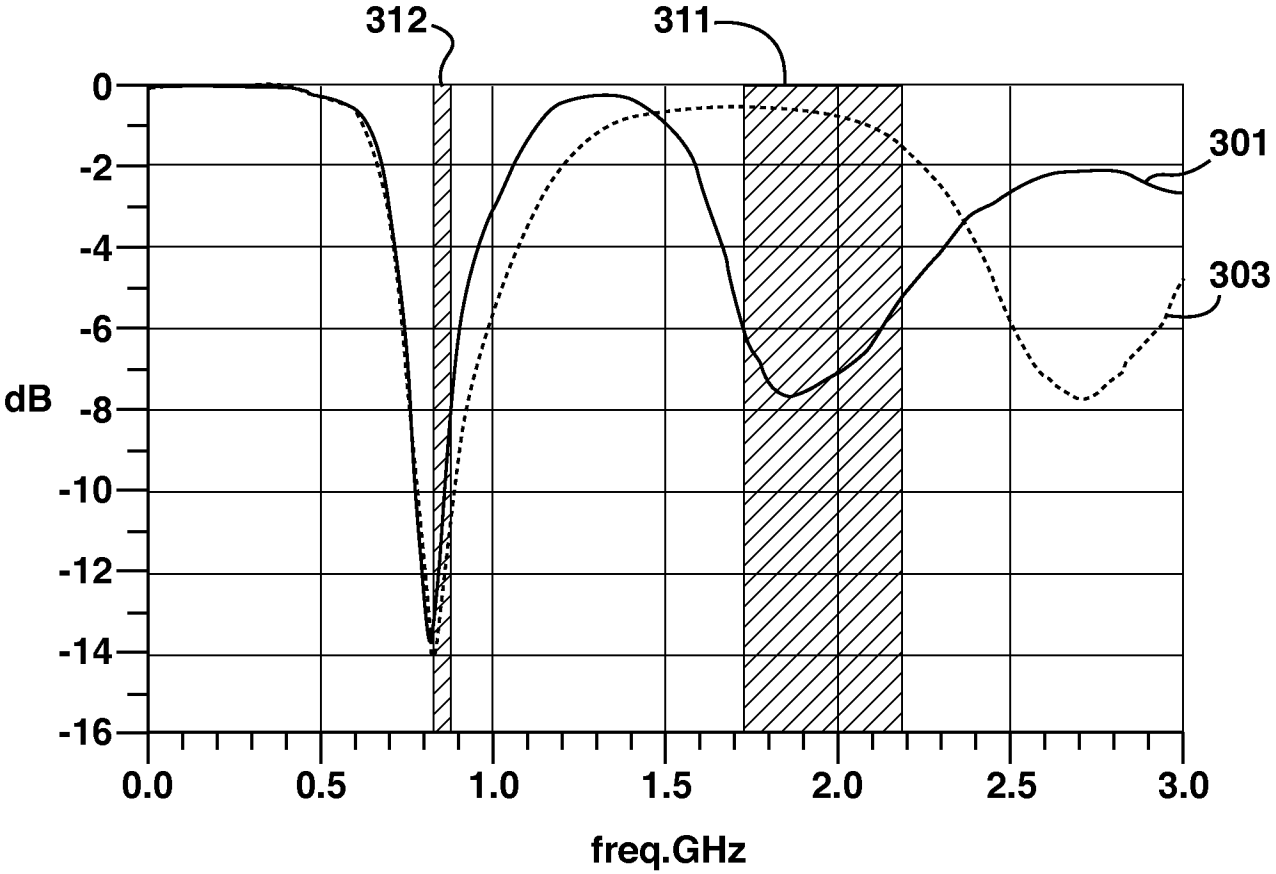
FIG. 3 depicts a return-loss curve of the antenna of FIG. 2, and a return-loss curve of an equivalent monopole antenna without the bandpass/bandstop filter network, according to non-limiting implementations.

Specifically, FIG. 3 depicts two return-loss curves 301, 303 generated using simulation software: a return-loss curve 301 of antenna 200; and a return-loss curve 303 of a monopole antenna corresponding to a length, and the like, of a combination of first radiating arm 201 and second radiating arm 202 without bandstop filter 203 or bandpass filter 205 there between (e.g., a monopole antenna of the "Low Band" length of FIG. 2).

FIG. 3 also indicates a first frequency range 311 of about 1750 MHz to about 2200 MHz, and a second frequency range 312 of about 800 MHz to about 900 MHz, both GSM bands; it is appreciated that in these implementations, antenna 200 is configured and/or designed so that resonances occur in each of first frequency range 311 and second frequency range 312.

In any event, return-loss curve 303 shows that the above described monopole antenna has a resonance around 800 MHz (within second frequency range 312) and a third harmonic around 2700 MHz, which is out of band for in this design. This third harmonic inherently comes from the dominant-mode frequency at around 800 MHz and is out-of-band in this design; if the dominant-mode resonance is varied (e.g. by changing a length of the monopole antenna), the third-harmonic-mode resonance also varies accordingly.

Return-loss curve 301 shows that antenna 200 has a resonance around 800 MHz (within second frequency range 312), similar to the monopole antenna of return-loss curve 303, which corresponds to a combination of first radiating arm 201 and second radiating arm 202; however, in contrast to return-loss curve 303, return-loss curve 301 of antenna 200 has another resonance around 1800 MHz (within first frequency range 311) corresponding to first radiating arm 201. Furthermore, filter network 210 (i.e. bandstop filter 203 and bandpass filter 205) filter out and/or remove the third harmonic at around 2700 MHz. In other words, filter network 210 is configured to remove redundant resonances and/or harmonic resonances of the combination of first radiating arm 201 and second radiating arm 202.

It is appreciated that the resonance at around 1800 MHz of return-loss curve 301 does not come from a dominant-mode resonance of the combination of first radiating arm 201 and second radiating arm 202, but from first radiating arm 201 and frequency filtering of filter network 210. As such, separate dual-band operation of antenna 200 is enabled.

From another perspective, antenna 200 comprises a single-branch monopole antenna that is physically split by a circuit and/or filter network comprising bandstop filter 203 and bandpass filter 205. In other words, first radiating arm 201 determines the higher frequency resonance in first frequency range 311 and is independent of a length of second radiating arm 202 in high frequency operation. The lower resonance in second frequency range 312 corresponds to a resonance of the entire length of first radiating arm 201 and second radiating arm 202, as filter network 210 acts as an open circuit in high frequency, and as a short circuit in low frequency.

Figure 4:
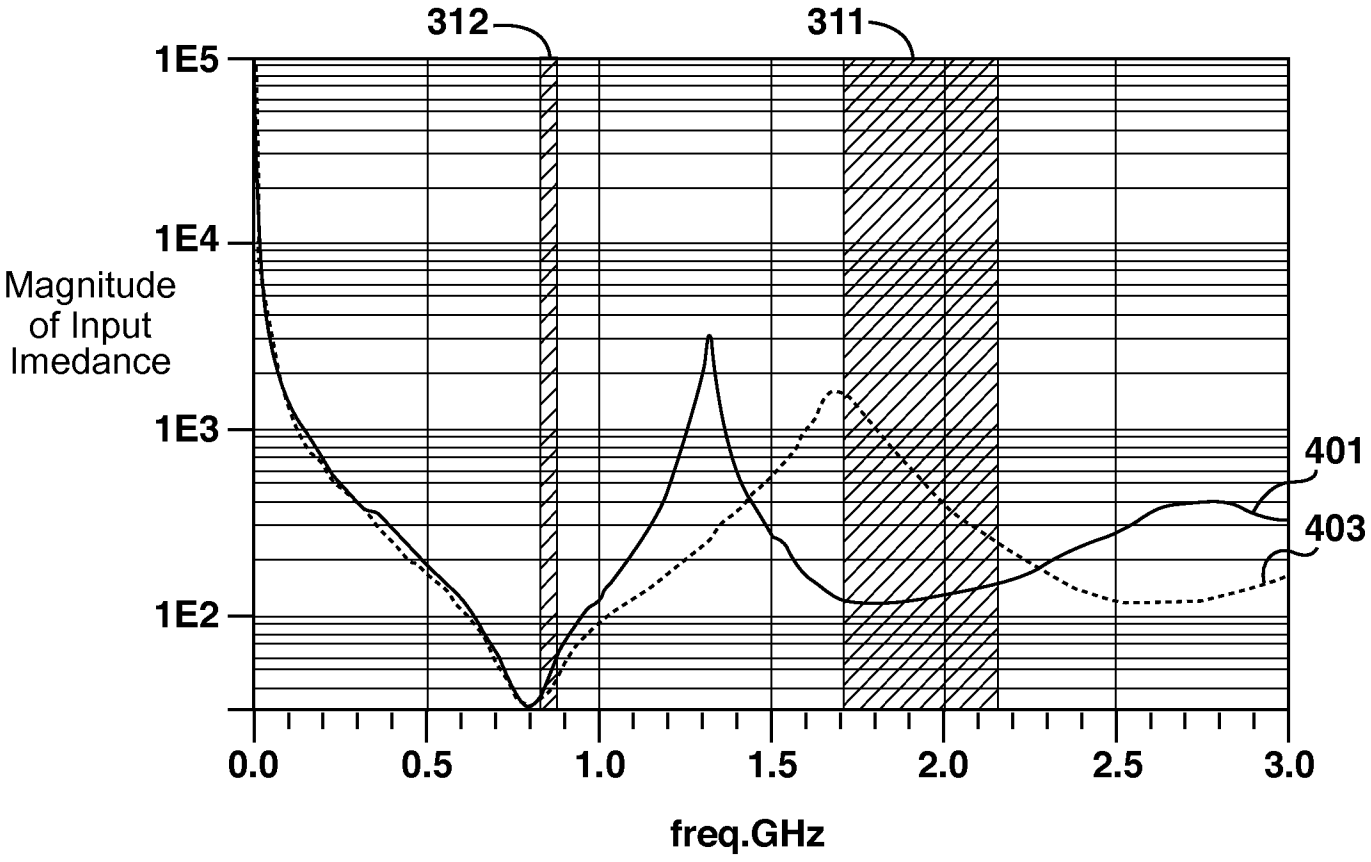
FIG. 4 depicts an input impedance curve of the antenna of FIG. 2, and an input impedance curve of an equivalent monopole antenna without the bandpass/bandstop filter network, according to non-limiting implementations.

For example, attention is directed to FIG. 4, which depicts an input impedance curve 401 of the same specific non-limiting implementations of antenna 200 described above with respect to FIG. 3, as a function of frequency, and an input impedance curve 403 of the same monopole antenna described above with respect to FIG. 3. Magnitude of input impedance is depicted on the y-axis, and frequency, from about 0 MHz to about 3000 MHz (i.e. about 3 GHz), is depicted on the x-axis. First frequency range 311 and second frequency range 312 are also indicated.

Input impedance curve 401 of antenna 200 shows relatively high impedance around 1800 MHz (and within first frequency range 311) and relatively low impedance around 800 MHz (and within second frequency range 312). In contrast, input impedance curve 403 of the monopole antenna shows a similar impedance to input impedance curve 401 of antenna 200 in second frequency range 312; however, input impedance curve 403 of the monopole antenna has a relatively higher impedance (by at about an order of magnitude than input impedance curve 401), in first frequency range 311. Furthermore, input impedance curve 403 has a relatively impedance than input impedance curve 401 around 2700 MHz, the frequency of the third harmonic depicted in FIG. 3.

Differences between the same specific non-limiting implementations of antenna 200 and the monopole antenna described above with respect to FIG. 3 are further illustrated in FIG. 5 which depicts transmission coefficients 501 (i.e. S21) and reflection coefficients 503 (i.e. S11) of specific non-limiting implementations of filter network 210 described above with respect to FIG. 3. Decibels are depicted on the y-axis and frequency, from about 400 MHz (i.e. 0.4 GHz) to about 3000 MHz (i.e. about 3 GHz), is depicted on the x-axis. First frequency range 311 and second frequency range 312 are also indicated.

Transmission coefficients 501 show that transmission occurs in second frequency range 312, as filter network 210 acts as a short circuit in this frequency range; transmission coefficients 501 are relatively reduced by orders of magnitude in second frequency range 311 as filter network 210 acts as an open circuit in this frequency range. Similarly, reflection coefficients 503 show very low reflection in second frequency range 312, and high reflection (by orders of magnitude) in first frequency range 311. There is an additional pronounced dip in transmission at about 2900 MHz as bandstop filter 203 filters (i.e. stops) higher frequencies very effectively.

For comparison, transmission coefficients 505 of only bandpass filter 205 are also depicted in FIG. 5 (i.e. bandpass filter 205 without bandstop filter 203). In second frequency range 312, transmission coefficients 505 are similar to transmission coefficients 501. However, in first frequency range 311, transmission coefficients 505 are about 10 dB lower than transmission coefficients 501. In other words, the addition of bandstop filter 203 sharpens the filtering of frequencies between first radiating arm 201 and second radiating arm 202 in first frequency range 311, as compared to bandpass filter 205 alone. Hence, bandstop filter 203 in filter network 210 provides additional frequency filtering in first frequency range 311 that significantly improves band selection in antenna 200 over the use of bandpass filter 205 alone. In some implementations, components of antenna 200 are generally connected in the following order: first radiating arm 201 (connectable to antenna feed 111), bandstop filter 203, bandpass filter 205, second radiating arm 202.

A successful prototype of antenna 200 was built similar to non-limiting implementations of antenna 200 described above with respect to FIG. 3, on a 0.8 mm thick FR4 substrate and using a high-Q inductor to mitigate insertion loss, and a return-loss curve 601 of the successful prototype is shown in FIG. 6, in a frequency range of about 650 MHz to about 3000 MHz, with frequency on the x-axis and return-loss on the y-axis in decibels. Design frequency bands are also depicted in stippled lines, from about 1700 MHz to about 1900 MHz (roughly corresponding to first frequency range 311 described above) and about 800 MHz to about 900 MHz (corresponding to second frequency range 312 described above). It is appreciated that resonances in return-loss curve 601 occur in the design frequency bands. For comparison, a return-loss curve 603 of a prototype of the same monopole antenna described above with respect to FIG. 3 is also shown, which has similar characteristics of simulated return-loss curve 303 of FIG. 3, with a resonance at about 900 MHz and a third harmonic at just below 3000 MHz.

Attention is next directed to FIG. 7, which depicts three antennas 200*a*, 200*b*, 200*c*, each similar to antenna 200, with like elements having like numbers but respectively with an "a", "b" and "c" appended thereto. Antenna 115 can comprise one or more of antennas 200*a*, 200*b*, 200*c*.

Antenna 200*a* comprises a first radiating arm 201*a* (connectable to antenna feed 111), a second radiating arm 202*a*, and a filter network 210*a* there between, comprising a bandstop filter 203*a* and bandpass filter 205*a*, each of bandstop filter 203*a* and bandpass filter 205*a* shown schematically. Similarly, antenna 200*b* comprises a first radiating arm 201*b* (connectable to antenna feed 111), a second radiating arm 202*b*, and a filter network 210*b* there between, comprising a bandstop filter 203*b* and bandpass filter 205*b*, each of bandstop filter 203*b* and bandpass filter 205*b* shown schematically. Finally, antenna 200*c* comprises a first radiating arm 201*c* (connectable to antenna feed 111), a second radiating arm 202*c*, and a filter network 210*c* there between, comprising a bandstop filter 203*c* and bandpass filter 205*c*, each of bandstop filter 203*c* and bandpass filter 205*c* shown schematically.

Furthermore a length of each antenna 200*a*, 200*b*, 200*c* is about the same, but a relative location of each combination of bandstop filter 203*a*, 203*b*, 203*c* and bandpass filter 205*a*, 205*b*, 205*c* within each antenna 200*a*, 200*b*, 200*c* is different. For example first radiating arm 201*a* is shorter than first radiating arm 201*b*, and first radiating arm 201*b* is shorter than first radiating arm 201*c*. Hence, a length of second radiating arm 202*a* is longer than a length of second radiating arm 202*b*, and a length of second radiating arm 202*b* is longer than a length of second radiating arm 202*c*.

In other words, while the total length of each antenna 200*a*, 200*b*, 200*c* is about the same, the lengths of each of the respective radiating arms are different.

Hence, when the total length of each antenna 200*a*, 200*b*, 200*c* is about the same as antenna 200, the lower band resonance of each antenna 200*a*, 200*b*, 200*c* will be about the same as the lower band resonance of antenna 200. For example, when the lower band resonance of antenna 200 is in a range of 800 MHz to 900 MHz, then the lower band resonance of antennas 200*a*, 200*b*, 200*c* are also in a range of 800 MHz to 900 MHz.

However, as the length of first radiating arms 201*a*, 201*b*, 201*c* varies, a higher band resonance of each antenna 200*a*, 200*b*, 200*c* will vary depending on a length of first radiating arms 201*a*, 201*b*, 201*c*. It is appreciated that values of components of filter networks 210*a*, 210*b*, 210*c* are adjusted accordingly to act as short circuits at the lower band resonance frequency and as open circuits at the higher band resonance frequency.

In other words, each filter network 210*a*, 210*b*, 210*c* is generally configured to electrically isolate respective first radiating arms 201*a*, 201*b*, 201*c* and respective second radiating arms 202*a*, 202*b*, 202*c* at a respective frequency corresponding to a resonance length defined by a length of respective first radiating arms 201*a*, 201*b*, 201*c* and to electrically connect respective first radiating arms 201*a*, 201*b*, 201*c* and second radiating arms 202*a*, 202*b*, 202*c* at a frequency corresponding to a resonance length defined by a total length of respective first radiating arms 201*a*, 201*b*, 201*c* and second radiating arms 202*a*, 202*b*, 202*c*.

Hence, unlike a conventional monopole, a higher resonance frequency of antennas 200, 200*a*, 200*b* 200*c* is controllable regardless of the total length of the monopole. This advantageous for antenna designers in that a single-branched antenna, split by a bandstop/bandpass filter network, can support dual or multiband operations.

Attention is next directed to FIG. 8 which depicts an antenna 200*d*, similar to antenna 200, with like elements having like numbers, however with a "d" appended thereto. Antenna 115 can comprise antenna 200*d*. Antenna 200*d* comprises a first radiating arm 201*d* (connectable to antenna feed 111), a second radiating arm 202*d*, and a filter network 210*d* there between, comprising a bandstop filter 203*d* and bandpass filter 205*d*, each of bandstop filter 203*d* and bandpass filter 205*d* shown schematically. It is appreciated that first radiating arm 201*d* resonates at a first frequency and that the combination of second radiating arm 202*d* and first radiating arm 201*d* resonate at a second frequency lower than the first frequency, as described above. Further, filter network 210*d* is configured to: electrically isolate first radiating arm 201*d* from second radiating arm 202*d* at the first frequency, and electrically connect first radiating arm 201*d* and second radiating arm 202*d* at the second frequency.

However, antenna 200*d* further comprises: a third radiating arm 803, third radiating arm 803, second radiating arm 202*d* and first radiating arm 201*d*, when electrically connected, configured to resonate at a third frequency lower than the second frequency; and, a second filter network 810 comprising a second bandstop filter 813 and a second bandpass filter 815, second filter network 810 filtering a respective electrical connection between second radiating arm 202*d* and third radiating arm 803, second filter network 810 configured to: electrically isolate second radiating arm 202*d* from third radiating arm 803 at the second frequency, and electrically connect second radiating arm 202*d* and third radiating arm 803 at the third frequency.

Furthermore, each filter network 210*d* is further configured to electrically connect first radiating arm 201*d* to second radiating arm 202*d* at the third frequency. Hence, the circuits and/or components of filter network 210*d*, and/or bandstop filter 203*d* and bandpass filter 205*d*, can be different than circuits and/or components of filter network 210, and/or bandstop filter 203 and bandpass filter 205, in order to provide the additional functionality at the third frequency.

In any event, antenna 200*d* resonates at three different frequencies: a first frequency corresponding to a length of first radiating arm 201*d* (the length labelled as "High Band" in FIG. 2), a second frequency corresponding to a total length of first radiating arm 201*d* combined with second radiating arm 202*d* (the total length labelled as "Low Band"

in FIG. 2), and a third frequency corresponding to a total length of first radiating arm 201*d* combined with second radiating arm 202*d* and third radiating arm 803 (the total length labelled as "Lowest Band" in FIG. 2). As the "High Band" length is shorter than the "Low Band" length, the first frequency will be higher than the second frequency, as with antenna 200; similarly, as the "Low Band" length is shorter than the "Lowest Band" length, the second frequency will be higher than the third frequency.

In other words, as the frequency increases, the effective length of antenna 200*d* decreases in steps from the "Lowest Band" length to the "Low Band" length to the "High Band" length, as each bandstop/bandpass filter network (i.e. bandstop filter 203*d* combined with bandpass filter 205*d*, and second bandstop filter 813 combined with second bandpass filter 815) filters successively higher frequencies. In this manner, antenna 200*d* is configured to resonate at three different frequencies.

Hence, for example antenna 200*d* could be configured to resonate in frequency bands corresponding to 700 to 960 MHz, 1710-2170 MHz, and 2500-2700 MHz.

Attention is next directed to FIG. 9 which depicts an antenna 200*e*, similar to antenna 200, with like elements having like numbers, however with an "e" appended thereto. Antenna 115 can comprise antenna 200*e*. Antenna 200*e* comprises a first radiating arm 201*e* (connectable to antenna feed 111), a second radiating arm 202*e*, and a filter network 210*e* there between comprising a bandstop filter 203*e* and bandpass filter 205*e*, each of bandstop filter 203*e* and bandpass filter 205*e* shown schematically. It is appreciated that first radiating arm 201*e* resonates at a first frequency and that the combination of second radiating arm 202*e* and first radiating arm 201*e* resonate at a second frequency lower than the first frequency, as described above. Further filter network 210*e* electrically isolates first radiating arm 201*e* from second radiating arm 202*e* at the first frequency, and electrically connects first radiating arm 201*e* from second radiating arm 202*e* at the second frequency.

However, antenna 200*d* further comprises at least a third radiating arm 903 connectable to antenna feed 111, third radiating arm 903 configured to resonate at a third frequency different from the first frequency and the second frequency.

Third radiating arm 903, as depicted, can be shorter than first radiating arm 201*e* so that third radiating arm 903 resonates at a higher frequency than first radiating arm 201*e*. Alternatively, third radiating arm 903 can be longer than first radiating arm 201*e*, but shorter than the combination of first radiating arm 201*e* and second radiating arm 202*e*, so that third radiating arm 903 resonates at a frequency between the first frequency and the second frequency. In yet a further alternative, third radiating arm 903 can be longer the combination of first radiating arm 201*e* and second radiating arm 202*e*, so that third radiating arm 903 resonates at a frequency lower than the second frequency. However, a length of third radiating arm 903 can also be similar to a length of first radiating arm 201*e* or a length of a combination of first radiating arm 201*e* and second radiating arm 202*e* to provide more coverage of the respective frequency bands.

For example, when first radiating arm 201*e* and second radiating arm 202*e* are configured to resonate in frequency ranges of about 700 to about 960 MHz, and about 1710 to about 2170 MHz, third radiating arm 903 can be configured to resonate in a frequency range of about 2500 to about 2700 MHz, so that antenna 200*e* has tri-band coverage of commercial frequency ranges (e.g. for LTE bands, GSM bands, UMTS bands, and/or WLAN bands).

In yet further implementations, antenna 200*e* can comprise more than one additional radiating arm connectable to antenna feed 111, similar to third radiating arm 903, of a similar or different length to third radiating arm 903. When the more than one additional radiating arm is of a different length than third radiating arm 903, antenna 200*e* has at least four-band coverage.

Furthermore, while third radiating arm 903 is depicted as parallel to first radiating arm 201*e*, in other implementations, third radiating arm 903 can be perpendicular to first radiating arm 201*e*, or at any other angle. Indeed the orientation of each of third radiating arm 903 is generally appreciated to be non-limiting.

Persons skilled in the art will appreciate that there are yet more alternative implementations and modifications possible. For example, attention is next directed to FIG. 10 which depicts an antenna 200*f*, substantially similar to antenna 200, with like elements having like numbers, but with an "f" appended thereto. Antenna 115 can comprise antenna 200*f*. Antenna 200*f* comprises: a first radiating arm 201*f* connectable to antenna feed 111, first radiating arm 201*f* configured to resonate at a first frequency; a second radiating arm 202*f*, second radiating arm 202*f* and first radiating arm 201*f*, when electrically connected, configured to resonate at a second frequency lower than the first frequency; a filter network 210*f* comprising a bandstop filter 203*f* and a bandpass filter 205*f*, filter network 210*f* filtering an electrical connection between first radiating arm 201*f* and second radiating arm 202*f*, filter network 210*f* configured to: electrically isolate first radiating arm 201*f* from second radiating arm 202*f* at the first frequency, and electrically connect first radiating arm 201*f* and second radiating arm 202*f* at the second frequency. Further, in specific non-limiting implementations, as depicted, bandstop filter 203*f* comprises an inductor 207*f* and a first capacitor 209*f* connected in parallel (and/or in shunt) between first radiating arm 201*f* and second radiating arm 202*f*. Further, in the depicted specific non-limiting implementations, bandpass filter 205*f* comprises inductor 207*f* and a second capacitor 211*f* connected in series with inductor 207*f*, second capacitor 211*f* located between inductor 207*f* and second radiating arm 202*f*. Second capacitor 211*f* is also connected in parallel with first capacitor 209*f*.

However, each of first radiating arm 201*f* and second radiating arm 202*f* are different widths, with second radiating arm 202*f* being wider than first radiating arm 201*f*. By varying the width of one or more of first radiating arm 201*f* and second radiating arm 202*f*, resonances of antenna 200*f* can be changed; furthermore, antenna efficiency and bandwidth can be increased.

It is yet further appreciated that for antenna 200*d*, comprising first radiating arm 201*d*, second radiating arm 202*d* and third radiating arm 803, widths of each of first radiating arm 201*d*, second radiating arm 202*d* and third radiating arm 803 can be different from one another. For example, attention is next directed to FIG. 11 which depicts an antenna 200*g*, substantially similar to antenna 200*d*, with like elements having like numbers, but with a "g" appended thereto. Antenna 115 can comprise antenna 200*g*. Antenna 200*g* comprises a first radiating arm 201*g* (connectable to antenna feed 111), a second radiating arm 202*g*, and a filter network 210*g* there between, comprising a bandstop filter 203*g* and bandpass filter 205*g*, each of bandstop filter 203*g* and bandpass filter 205*g* shown schematically. Antenna 200*g* further comprises: a third radiating arm 803*g*, and, a second filter network 810*g* comprising a second bandstop filter 813*g* and a second bandpass filter 815*g*, similar to antenna 200*d*.

However, each of first radiating arm 201*g*, second radiating arm 202*g* and third radiating arm 803*g* are different widths, with second radiating arm 202*g* being wider than first radiating arm 201*g*, and third radiating arm 803*g* being wider than second radiating arm 202*g*. By varying the width of one or more of first radiating arm 201*g*, second radiating arm 202*g* and third radiating arm 803*g*, resonances of antenna 200*g* can be changed; furthermore, antenna efficiency and bandwidth can be increased.

Attention is next directed to FIG. 12 which depicts an antenna 200*h*, substantially similar to antenna 200, with like elements having like numbers, but with an "h" appended thereto. Antenna 115 can comprise antenna 200*h*. Antenna 200*h* comprises: a first radiating arm 201*h* connectable to antenna feed 111, first radiating arm 201*h* configured to resonate at a first frequency; a second radiating arm 202*h*, second radiating arm 202*h* and first radiating arm 201*h*, when electrically connected, configured to resonate at a second frequency lower than the first frequency; a filter network 210*h* comprising a bandstop filter 203*h* and a bandpass filter 205*h*, filter network 210*h* filtering an electrical connection between first radiating arm 201*h* and second radiating arm 202*h*, filter network 210*h* configured to: electrically isolate first radiating arm 201*h* from second radiating arm 202*h* at the first frequency, and electrically connect first radiating arm 201*h* and second radiating arm 202*h* at the second frequency.

Further, bandstop filter 203*h* comprises an inductor 207*h*, and a capacitor 209*h*, and bandpass filter 205*h* comprises inductor 207*h* and a capacitor 211*h*. However, in these implementations, one or more of each of bandstop filter 203*h* and bandpass filter 205*h* are tunable. For example, as depicted, antenna 200*h* further comprises at least one tunable capacitor 1209, 1211 for one or more of each of bandstop filter 203*h* and bandpass filter 205*h*. Specifically, as depicted, bandstop filter 203*h* comprises tunable capacitor 1209 in series with capacitor 209*h*, and in parallel with inductor 207*h*; and bandpass filter 205*h* comprises tunable capacitor 1211 in series with capacitor 211*h* and inductor 207*h*.

In order to tune each of tunable capacitor 1209, 1211, antenna 200*h* further comprises: a directional coupler 1213 capacitively coupled to first radiating arm 201*h*; a spectrum analyzer 1214 and a microcontroller 1215 in communication with directional coupler 1213 and at least one tunable capacitor 1209, 1211, spectrum analyzer 1214 configured to determine an input frequency of first radiating arm 201*h* and microcontroller 1215 configured to tune at least one tunable capacitor 1209, 1211 according to the input frequency. Directional coupler 1213 can terminate at an impedance termination port 1216, which provides both a reference impedance, and minimizes reflection from termination port 1216.

In other words, directional coupler 1213 couples to first radiating arm 201*h* and measures and/or samples an input frequency thereof; spectrum analyzer 1214 receives a signal from directional coupler 1213, and determines the input frequency of first radiating arm 201*h* from the signal, i.e. the input frequency received from antenna feed 111. For example, the input frequency can comprise the first frequency or the second frequency. The input frequency is determined, and spectrum analyzer 1214 communicates the input frequency to microcontroller 1215, which can responsively control at least one tunable capacitor 1209, 1211 accordingly, via respective outputs to each of tunable capacitors 1209, 1211.

The capacitance values to which each of tunable capacitors 1209, 1211 can be tuned can based on a lookup table, and the like, stored at microcontroller 1215. For example, each of tunable capacitors 1209, 1211 can be tuned to respective first values when the input frequency is about the first frequency, and each of tunable capacitors 1209, 1211 can be tuned to respective second values when the input frequency is about the second frequency. The respective first values and respective second values can be stored in a lookup table, and the like, in respective association with each of the first frequency and the second frequency. Further, if either of the first frequency or the second frequency drifts due to, for example, changes in input impedance at antenna 200*h*, at least one tunable capacitor 1209, 1211 can be tuned in a feedback loop with directional coupler 1213, spectrum analyzer 1214 and microcontroller 1215 to maintain the first frequency or the second frequency.

In FIG. 12, it is assumed that spectrum analyzer 1214 and microcontroller 1215 are combined into one device, however, in other implementations, spectrum analyzer 1214 and microcontroller 1215 can be separate devices in communication with each other, microcontroller 1215 receiving the measured input frequency from spectrum analyzer 1214.

As depicted, antenna 200*h* can optionally comprise one or more tuning stubs 1217-1, 1217-2 located before and/or after filter network 210*h* to provide additional tuning capability. Each tuning stub 1217-1, 1217-2 can receptively contribute at least some impedance matching for each of first radiating arm 201*h* and second radiating arm 202*h*. Each tuning stub 1217-1, 1217-2 can be a same or different size as each of first radiating arm 201*h* and second radiating arm 202*h*.

Further while only two tunable capacitors 1209, 1211 are depicted in FIG. 12, in other implementations, filter network 210*h* can comprise more than two tunable capacitor and/or at least one tunable inductor.

Attention is next directed to FIG. 13 which depicts transmission coefficients 1301-1, 1301-2 (i.e. S21) and reflection coefficients 1303-1, 1303-2 (i.e. S11) of specific non-limiting implementations of filter network 210*h* as a capacitance value of tunable capacitor 1211 is decreased. It is assumed in FIG. 13 that a value of tunable capacitor 1209 is fixed. Decibels are depicted on the y-axis and frequency, from about 500 MHz (i.e. 0.5 GHz) to about 3500 MHz (i.e. about 3.5 GHz), is depicted on the x-axis.

Specifically transmission coefficients 1301-1 and reflection coefficients 1303-1 represent a response of filter network 210*h* when tunable capacitor 1211 is at a first capacitance value, and transmission coefficients 1301-2 and reflection coefficients 1303-2 represent a response of filter network 210*h* when tunable capacitor 1211 is at a second capacitance value lower than the first capacitance value.

It is apparent from FIG. 13 that resonance frequencies of both transmission and reflection of filter network 210*h* generally increase to higher frequencies as a capacitance of tunable capacitor 1211 is decreased, the increase in resonance frequencies represented by arrows 1305, 1307. It is further appreciated that a resonance in transmission is indicative of frequencies at which filter network 210*h* electrically connects first radiating arm 201*h* with second radiating arm 202*h*. Similarly, a resonance in reflection is indicative of frequencies at which filter network 210*h* electrically isolates first radiating arm 201*h* from second radiating arm 202*h*.

Attention is next directed to FIG. 14 which depicts transmission coefficients 1401-1, 1401-2 (i.e. S21) and reflection coefficients 1403 of specific non-limiting implementations of filter network 210*h* as a capacitance value of tunable capacitor 1209 is decreased. It is assumed in FIG. 14 that a value of tunable capacitor 1211 is fixed. Decibels are depicted on the y-axis and frequency, from about 500 MHz (i.e. 0.5 GHz) to about 3500 MHz (i.e. about 3.5 GHz), is depicted on the x-axis.

Specifically transmission coefficients 1401-1 represent a response of filter network 210*h* when tunable capacitor 1211 is at a first capacitance value, and transmission coefficients 1401-2 represent a response of filter network 210*h* when tunable capacitor 1211 is at a second capacitance value lower than the first capacitance value. Reflection coefficients 1403 represent a response of filter network 210*h* at each capacitance value: in other words, reflection is substantially similar at each capacitance value.

It is apparent from FIG. 14 that resonance frequencies of transmission of filter network 210*h* generally increases to higher frequencies as a capacitance of tunable capacitor 1209 is decreased, the increase in resonance frequency represented by arrow 1405. However, a resonance frequency of reflection of filter network 210*h* is generally unchanged; indeed, reflection coefficients 1403 represent It is further appreciated that a resonance in transmission is indicative of frequencies at which filter network 210*h* electrically connects first radiating arm 201*h* with second radiating arm 202*h*. Similarly, a resonance in reflection is indicative of frequencies at which filter network 210*h* electrically isolates first radiating arm 201*h* from second radiating arm 202*h*.

Hence, from FIGS. 13 and 14, it is apparent that when a desired frequency of resonance begins to increase, a capacitance of one or more of tunable capacitors 1209, 1211 can be decreased, and similarly when a desired frequency of resonance begins to decrease, a capacitance of one or more of tunable capacitors 1209, 1211 can be increased. Changes in the frequencies can be determined using directional coupler 1213 and spectrum analyzer 1214.

Attention is next directed to FIG. 15 which depicts an antenna 200*i*, substantially similar to antenna 200, with like elements having like numbers, but with an "i" appended thereto. Antenna 115 can comprise antenna 200*i*. Antenna 200*i* comprises: a first radiating arm 201*i* connectable to antenna feed 111, first radiating arm 201*i* configured to resonate at a first frequency; a second radiating arm 202*i*, second radiating arm 202*i* and first radiating arm 201*i*, when electrically connected, configured to resonate at a second frequency lower than the first frequency; a filter network 210*i* comprising a bandpass filter 205*i* and a bandstop filter 203*i*, filter network 210*i* filtering an electrical connection between first radiating arm 201*i* and second radiating arm 202*i*, filter network 210*i* configured to: electrically isolate first radiating arm 201*i* from second radiating arm 202*i* at the first frequency, and electrically connect first radiating arm 201*i* and second radiating arm 202*i* at the second frequency. Filter network 210*i* is connected in shunt from each of first radiating arm 201*i* and second radiating arm 202*i* to a ground 1501, for example a ground plane of device 101.

Further, bandpass filter 205*i* comprises an inductor 207*i*, and a capacitor 209*i*, and bandstop filter 203*i* comprises inductor 1511 and capacitor 209*i*. Similar to antenna 200*h*, in these implementations, each of bandpass filter 205*i* and bandstop filter 203*i* are tunable. For example, as depicted, antenna 200*i* further comprises at least one tunable capacitor 1509 common to both bandpass filter 205*i* and bandstop filter 203*i*. Specifically, as depicted, bandpass filter 205*i* comprises inductor 207*i* in parallel with at least one tunable capacitor 1509, which is in series with capacitor 209*i*, to ground 1501; and bandstop filter 203*i* comprises inductor 1511 in series with at least one tunable capacitor 1509 and capacitor 209*i* to ground 1501.

In order to tune at least one tunable capacitor 1509, antenna 200*i* further comprises: a directional coupler 1213*i* capacitively coupled to first radiating arm 201*i*; a spectrum analyzer 1214*i* and a microcontroller 1215*i* in communication with directional coupler 1213*i* and at least one tunable capacitor 1509, spectrum analyzer 1214*i* configured to determine an input frequency of first radiating arm 201*i*, and microcontroller 1215*i* configured to tune at least one tunable capacitor 1509 according to the input frequency. Directional coupler 1213*i* can terminate at an impedance termination port 1216*i*, which provides both a reference impedance, and minimizes reflection from termination port 1216*i*.

In other words, directional coupler 1213*i* couples to first radiating arm 201*i* and measures and/or samples an input frequency thereof; spectrum analyzer 1214*i* receives a signal from directional coupler 1213*i*, and determines the input frequency of first radiating arm 201*i* from the signal, i.e. the input frequency received from antenna feed 111. For example, the input frequency can comprise the first frequency or the second frequency. The input frequency is determined, and spectrum analyzer 1214*i* communicates the input frequency to microcontroller 1215*i*, which can responsively control at least one tunable capacitor 1509 accordingly, via an output to at least one tunable capacitor 1509.

The capacitance values to which at least one tunable capacitor 1509 can be tuned can based on a lookup table, and the like, stored at microcontroller 1215*i*. For example, at least one tunable capacitor 1509 can be tuned to a first value when the input frequency is about the first frequency, and at least one tunable capacitor 1509 can be tuned to a second value when the input frequency is about the second frequency. The first value and second value can be stored in a lookup table, and the like, in respective association with each of the first frequency and the second frequency. Further, if either of the first frequency or the second frequency drifts due to, for example, changes in input impedance at antenna 200*i*, at least one tunable capacitor 1509 can be tuned in a feedback loop with directional coupler 1213*i*, spectrum analyzer 1214*i* and microcontroller 1215*i* to maintain the first frequency or the second frequency In FIG. 15, it is assumed that spectrum analyzer 1214*i* and microcontroller 1215*i* are combined into one device, however, in other implementations, spectrum analyzer 1214*i* and microcontroller 1215*i* can be separate devices in communication with each other, microcontroller 1215*i* receiving the measured input frequency from spectrum analyzer 1214*i*.

As depicted, antenna 200*i* can optionally comprise one or more tuning stubs 1217*i*-1, 1217*i*-2 located before and/or after filter network 210*i* to provide additional tuning capability. Each tuning stub 1217*i*-1, 1217*i*-2 can receptively contribute at least some impedance matching for each of first radiating arm 201*i* and second radiating arm 202*i*. Each tuning stub 1217*i*-1, 1217*i*-2 can be a same or different size as each of first radiating arm 201*i* and second radiating arm 202*i*.

Further while only one tunable capacitor 1509 is depicted in FIG. 15, in other implementations, filter network 210*i* can comprise more than one tunable capacitor and/or at least one tunable inductor.

Attention is next directed to FIG. 16 which depicts transmission coefficients 1601-1, 1601-2 (i.e. S21) and reflection coefficients 1603-1, 1603-2 (i.e. S11) of specific non-limiting implementations of filter network 210*i* as a capacitance value of tunable capacitor 1509 is decreased. Decibels are depicted on the y-axis and frequency, from about 500 MHz (i.e. 0.5 GHz) to about 3500 MHz (i.e. about 3.5 GHz), is depicted on the x-axis.

Specifically transmission coefficients 1601-1 and reflection coefficients 1603-1 represent a response of filter network 210*i* when tunable capacitor 1509 is at a first capacitance value, and transmission coefficients 1601-2 and reflection coefficients 1603-2 represent a response of filter network 210*i* when tunable capacitor 1509 is at a second capacitance value lower than the first capacitance value.

It is apparent from FIG. 16 that resonance frequencies of both transmission and reflection of filter network 210*i* generally increase to higher frequencies as a capacitance of tunable capacitor 1509 is decreased, the increase in resonance frequencies represented by arrows 1605, 1607. It is further appreciated that a resonance in transmission is indicative of frequencies at which filter network 210*i* electrically connects first radiating arm 201*i* with second radiating arm 202*i*. Similarly, a resonance in reflection is indicative of frequencies at which filter network 210*i* electrically isolates first radiating arm 201*i* from second radiating arm 202*i*.

Hence, from FIG. 16, it is apparent that when a desired frequency of resonance begins to increase, a capacitance of tunable capacitor 1509 can be decreased, and similarly when a desired frequency of resonance begins to decrease, a capacitance of tunable capacitors 1509 can be increased. Changes in the frequencies can be determined using directional coupler 1213*i* and spectrum analyzer 1214*i*.

Hence, from at least FIGS. 12 and 15 it is apparent that a variety of filter networks, comprising bandstop filters and bandpass filters, are within the scope of present implementations.

In any event, antennas with a combined bandpass/bandstop filter network are described herein that can replace a plurality of antennas at a mobile electronic device. The specific resonance bands of the antennas described herein can be varied by varying the dimensions of components of the antennas to advantageously align the bands with bands used by service providers, and by providing a bandpass/bandstop filter network between radiating arms to control a resonant length of the antennas. In some implementations, capacitance and/or inductance of one or more of bandstop filters and bandpass filters can be tuned. Further, the present antennas obviate the need to use different antennas for different bands in different regions.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is only to be limited by the claims appended here.

What is claimed is:

1. An antenna comprising:

a first radiating arm connectable to an antenna feed, the first radiating arm configured to resonate at a first frequency the first radiating arm having a first end and a second end opposite the first end, the first radiating arm connectable to the antenna feed at the first end;

a second radiating arm, the second radiating arm and the first radiating arm, together, configured to resonate at a second frequency lower than the first frequency, each of the first radiating arm and the second radiating arm comprising respective straight monopole antennas;

a direct electrical connection between the second end of the first radiating arm and the second radiating arm; and, a filter network comprising a bandstop filter and a bandpass filter, connected in shunt from each of the first radiating arm and the second radiating arm to a ground, the shunt extending from the direct electrical connection between the first radiating arm and the second radiating arm, both of the bandstop filter and the bandpass filter located on the shunt and not on the direct electrical connection, the filter network filtering an electrical connection between the first radiating arm and the second radiating arm, the filter network configured to:

electrically isolate, on the direct electrical connection, the first radiating arm from the second radiating arm at the first frequency, and electrically connect, on the direct electrical connection, the first radiating arm and the second radiating arm at the second frequency.

2. The antenna of claim 1, wherein the first radiating arm has a length corresponding to resonance at the first frequency.

3. The antenna of claim 1, wherein the first radiating arm and the second radiating arm form a line and a total length of the first radiating arm and the second radiating arm corresponds to resonance at the second frequency.

4. The antenna of claim 1, wherein the first radiating arm and the second radiating behave as a single radiating arm at the second frequency.

5. The antenna of claim 1, wherein the filter network isolates the first radiating arm from the second radiating arm at the first frequency such that the second radiating arm does not contribute resonance at the first frequency.

6. The antenna of claim 1, wherein the bandstop filter comprises an inductor and a first capacitor connected in parallel between the first radiating arm and the second radiating arm.

7. The antenna of claim 6, wherein the bandpass filter comprises the inductor and a second capacitor connected in series with the inductor.

8. The antenna of claim 1, wherein the inductor has an inductance of about 22 nH, the first capacitor has a capacitance of about 0.15 pF, and the second capacitor has a capacitance of about 1.8 pF.

9. The antenna of claim 1, wherein the first radiating arm is configured to resonate between about 1800 MHz to about 2100 MHz.

10. The antenna of claim 1, wherein the combination of the first radiating arm electrically connected to the second radiating arm is configured to resonate between about 700 MHz to about 900 MHz.

11. The antenna of claim 1, further comprising:

a third radiating arm, the third radiating arm, the second radiating arm and the first radiating arm, when electrically connected, configured to resonate at a third frequency lower than the second frequency; and, a second filter network comprising a second bandstop filter and a second bandpass filter, the second filter network filtering a respective electrical connection between the second radiating arm and the third radiating arm, the second filter network configured to:

electrically isolate the second radiating arm from the third radiating arm at the second frequency, and electrically connect the second radiating arm and the third radiating arm at the third frequency.

12. The antenna of claim 11, wherein the filter network is further configured to electrically connect the first radiating arm to the second radiating arm at the third frequency.

13. The antenna of claim 1, further comprising at least a third radiating arm connectable to the antenna feed, the third radiating arm configured to resonate at a third frequency different from the first frequency and the second frequency.

14. The antenna of claim 1, wherein one or more of the bandstop filter and the bandpass filter are tunable.

15. The antenna of claim 1, wherein one or more of the bandstop filter and the bandpass filter comprise at least one tunable capacitor.

16. The antenna of claim 15, further comprising:

a directional coupler capacitively coupled to the first radiating arm; and, a spectrum analyzer and microcontroller in communication with the directional coupler and the at least one tunable capacitor, the spectrum analyzer configured to determine an input frequency of the first radiating arm and the microcontroller configured to tune the at least one tunable capacitor according to the input frequency.

17. The antenna of claim 1, wherein the first radiating arm and the second radiating arm are different widths.

18. The antenna of claim 1, further comprising: a first tuning stub extending from the direct electrical connection between the shunt and the first radiating arm, and a second tuning stub extending from the direct electrical connection between the shunt and the second radiating arm.

* * * * *